US006695654B2

(12) United States Patent
Simner

(10) Patent No.: US 6,695,654 B2
(45) Date of Patent: Feb. 24, 2004

(54) RETRACTABLE RUDDER SYSTEM FOR WATER JET PUMP VESSELS

(76) Inventor: Ronald E. Simner, 1870 Huxley Ct., San Jose, CA (US) 95125

( * ) Notice: Subject to any disclaimer, the term of this patent is extended or adjusted under 35 U.S.C. 154(b) by 0 days.

(21) Appl. No.: 10/280,450

(22) Filed: Oct. 25, 2002

(65) Prior Publication Data

US 2003/0082964 A1 May 1, 2003

Related U.S. Application Data

(60) Provisional application No. 60/347,926, filed on Oct. 26, 2001.

(51) Int. Cl.[7] ..... B63H 11/117
(52) U.S. Cl. ..... 440/43; 440/1; 114/162
(58) Field of Search ..... 114/162; 440/1, 440/38, 40, 43

(56) References Cited

U.S. PATENT DOCUMENTS

| | | | | |
|---|---|---|---|---|
| 4,008,677 | A | * 2/1977 | Wordell, Sr. | 114/162 |
| 4,807,553 | A | * 2/1989 | Brown | 114/152 |
| 5,167,547 | A | 12/1992 | Kobayashi et al. | |
| 5,310,369 | A | 5/1994 | Kobayashi | |
| 5,437,568 | A | 8/1995 | Kobayashi | |
| 5,755,601 | A | 5/1998 | Jones | |
| 5,813,357 | A | 9/1998 | Watson | |
| 6,086,437 | A | 7/2000 | Murray | |
| 6,124,809 | A | 9/2000 | Boudriau | |
| 6,159,059 | A | 12/2000 | Bernier et al. | |
| 6,174,210 | B1 | 1/2001 | Spade et al. | |
| 6,231,410 | B1 | 5/2001 | Bernier et al. | |
| 6,302,047 | B1 | 10/2001 | Cannon | |
| 6,305,307 | B1 | 10/2001 | Yokoya | |
| 6,383,041 | B1 | 5/2002 | Gronau | |
| 6,428,370 | B1 | 8/2002 | Jones | |
| 6,428,371 | B1 | 8/2002 | Michel et al. | |
| 6,428,372 | B1 | 8/2002 | Belt | |
| 2001/0018884 | A1 | 9/2001 | Marda et al. | |
| 2001/0027739 | A1 | 10/2001 | Simard et al. | |
| 2001/0051474 | A1 | 12/2001 | Matsuda et al. | |
| 2002/0016112 | A1 | 2/2002 | Matsuda | |
| 2002/0028613 | A1 | 3/2002 | Matsuda et al. | |
| 2002/0049010 | A1 | 4/2002 | Bernier et al. | |
| 2002/0073905 | A1 | 6/2002 | Nedderman, Jr. et al. | |
| 2002/0077009 | A1 | 6/2002 | Swartz et al. | |

* cited by examiner

*Primary Examiner*—Stephen Avila
(74) *Attorney, Agent, or Firm*—Burns, Doane, Swecker & Mathis LLP; Claude A. S. Hamrick; D'arcy Lorimer

(57) ABSTRACT

The invention discloses a retractable rudder device attached to the water jet nozzle of a watercraft. In a non-deployed condition, the rudders are latched in position and completely out of the water stream underneath the craft. When deployed, two rudders aligned with the axis of the steering nozzle, are rotated into position via springs and cables. The rudders pivot independently of each other, and will retract if contact with an underwater object is made or the craft is beached. A cable system connected to a control unit lowers the rudders into the deploy position. The cable system is actuated by a hydraulic cylinder using fluid pressure from the jet pump. The deployment rate can be varied by altering the fluid pressure in the hydraulic cylinder, and is a function of boat speed. Deployment of the retractable rudder system is determined by an electronic control system. Input variables such as steering rates, jet pump pressure, throttle position, engine operation, immersion of the craft in the water determine if the rudder system is deployed. An anticipatory steering module is included in the controller to provide dynamic steering conditions under which the rudder system is deployed prior to full lock.

52 Claims, 17 Drawing Sheets

STEERING FAULT
560
H
L
562
564
524
510
526
528
$t_2$
$t_3$
$t_4$
$t_7$

I2
550
552

I3
540
542
544
546
512
514
$t_5$
$t_6$ dA/dt
520
D2
D1
0
532
530
522
$t_1$ $d^2A/dt^2$
502
(+)
(-)
504
506
508
510
512
514

RETRACTABLE RUDDER SYSTEM FOR WATER JET PUMP VESSELS

CROSS REFERENCE TO RELATED APPLICATIONS

This application is related to provisional application No. 60/347,926 filed Oct. 26, 2001 entitled RETRACTABLE RUDDER SYSTEM FOR WATER JET PUMP VESSELS, and claims benefit thereof.

BACKGROUND OF THE INVENTION

1. Field of the Invention

The present invention relates to the off throttle steering response of jet pump propelled recreational watercraft. In particular, the invention relates to the deployment dynamics and control of a retractable rudder system to aid in the steering of recreational watercraft during off throttle or loss of power conditions.

2. Description of the Related Art

Water jet propelled recreational watercraft are very popular and are in use by large numbers of people throughout the world. These watercraft have become increasingly more powerful and capable of high speeds. The high speed capability inevitably leads to a requirement to avoid collisions, but the collision avoidance capability of these craft is severely hampered when the throttle is suddenly shut off, as might be the case when a pilot senses an imminent collision. Because these craft use a directed water jet to steer, shutting down the throttle can cause a lack of control, and create a collision in response to the same action taken to avoid it.

What is needed is a steering system to augment the jet propulsion system for the closed throttle condition. It would be of interest to have a system that not only responds to a closed throttle condition combined with full steering lock, but also has an anticipatory capability that senses steering rates and acceleration of steering rates to deploy the auxiliary system before lock is reached. In addition, it would be of interest to be able to deploy the steering system at a rate which is dependent on the speed of the craft, to avoid deploying devices at high craft speed that can cause unstable handling behaviors.

SUMMARY OF THE INVENTION

A retractable rudder system for water jet pump vessels is disclosed including at least one rudder pivotally disposed to rotate between a retracted position and a deployed position. A control means responsive to a throttle state condition, an immersion condition, and a steering condition is operative to generate an actuator control signal when the three conditions have predetermined states. An actuator means responsive to the control signal is operative to cause the rudder to rotate from the retracted position to the deployed position.

The invention discloses a retractable rudder device attached to the water jet nozzle of a watercraft. In a non-deployed condition, the rudders are latched in position and completely out of the water stream underneath the craft. When deployed, two rudders aligned with the axis of the steering nozzle, are rotated into position via springs and cables. The rudders pivot independently of each other, and will retract if contact with an underwater object is made or the craft is beached. A cable system connected to a control unit lowers the rudders into the deploy position. The cable system is actuated by a hydraulic cylinder using fluid pressure from the jet pump. The deployment rate can be varied by altering the fluid pressure in the hydraulic cylinder, and is a function of boat speed.

Deployment of the retractable rudder system is determined by an electronic control system. Input variables such as steering rates, jet pump pressure, throttle position, engine operation, immersion of the craft in the water determine if the rudder system is deployed. An anticipatory steering module is included in the controller to provide dynamic steering conditions under which the rudder system is deployed prior to full lock.

DETAILED DESCRIPTION OF THE PREFERRED EMBODIMENT(S)

Figure 1:
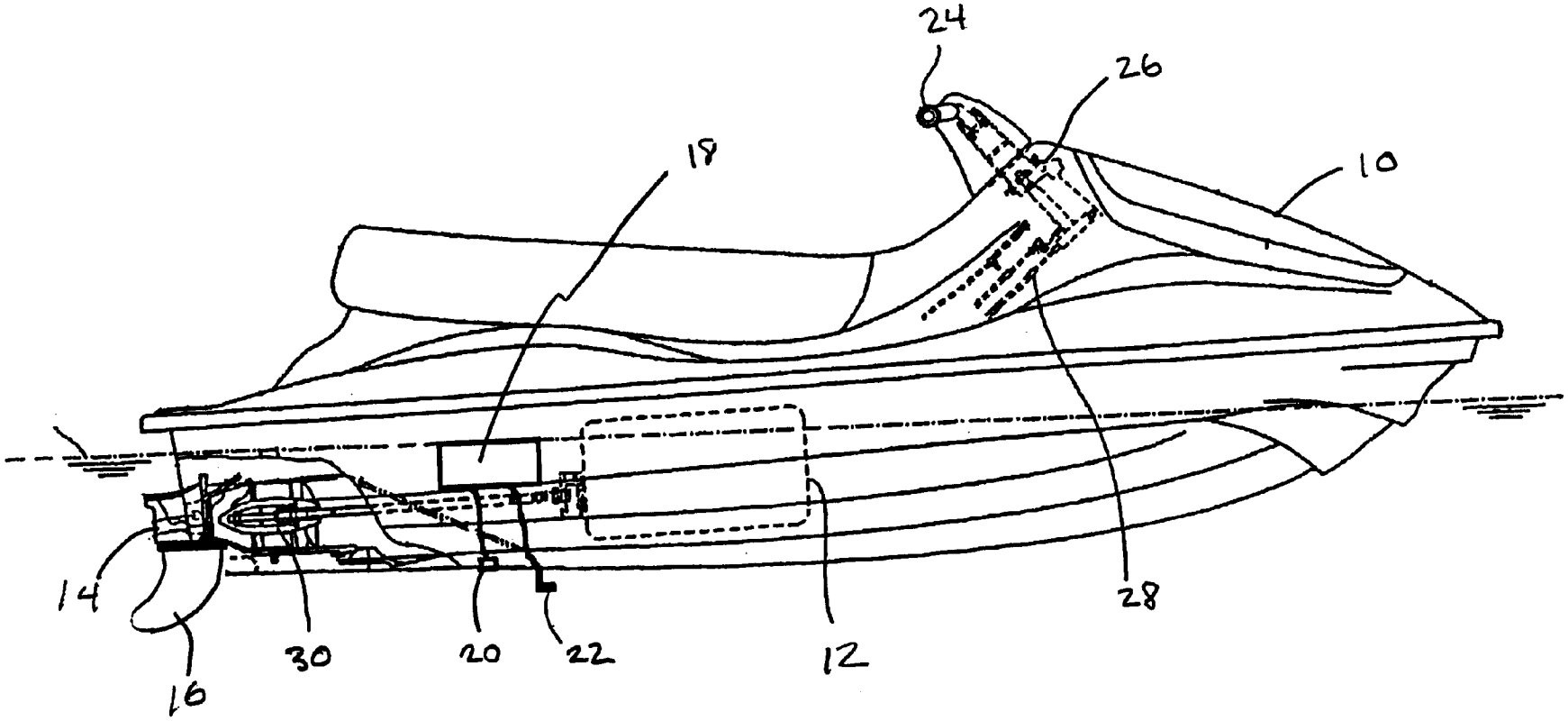
FIG. 1 is a side view of a personal water craft having a retractable rudder system according to an embodiment of the present invention.

FIG. 1 is a side view of a personal water craft 10 having a retractable rudder system according to an embodiment of the present invention. This craft is equipped with a steering nozzle assembly 14 to which are attached retractable rudders 16 of the present invention. The rudders are shown in the deployed position in this view. Two rudders are utilized, one on each side of the steering nozzle assembly. A housing 18 contains the electronic control circuits necessary for deploying the rudder system. Immersion sensor 20 is utilized to detect if the craft 10 is in the water. Sensor 22 may be a pressure sensor, optical sensor, and conductivity sensor. Pito tube 22 is utilized to detect the speed of the craft. However, sensor 22 may also be a paddle wheel type sensor, surface flow sensor, GPS sensor, or any other sensor capable of detecting motion of the craft. Housing 18 is also connected to pressure sensors (not shown) in thrust pump 30, to steering position sensors 26 on the steering assembly, to a throttle "OFF" position switch (not shown), and to a sensor (or output from the engine management system) to detect an engine stop run condition. Housing 18 may be provided as a separately packaged control unit or may be integrated with the onboard engine management systems as is well know in the art. The pilot steers the craft with hand grips 24. Steering inputs are transferred to nozzle assembly 14 via cables 28. Housing 18 is also connected to the mechanical control box (not show) to actuate the extension of steering rudders 16 into the water.

Figure 2:
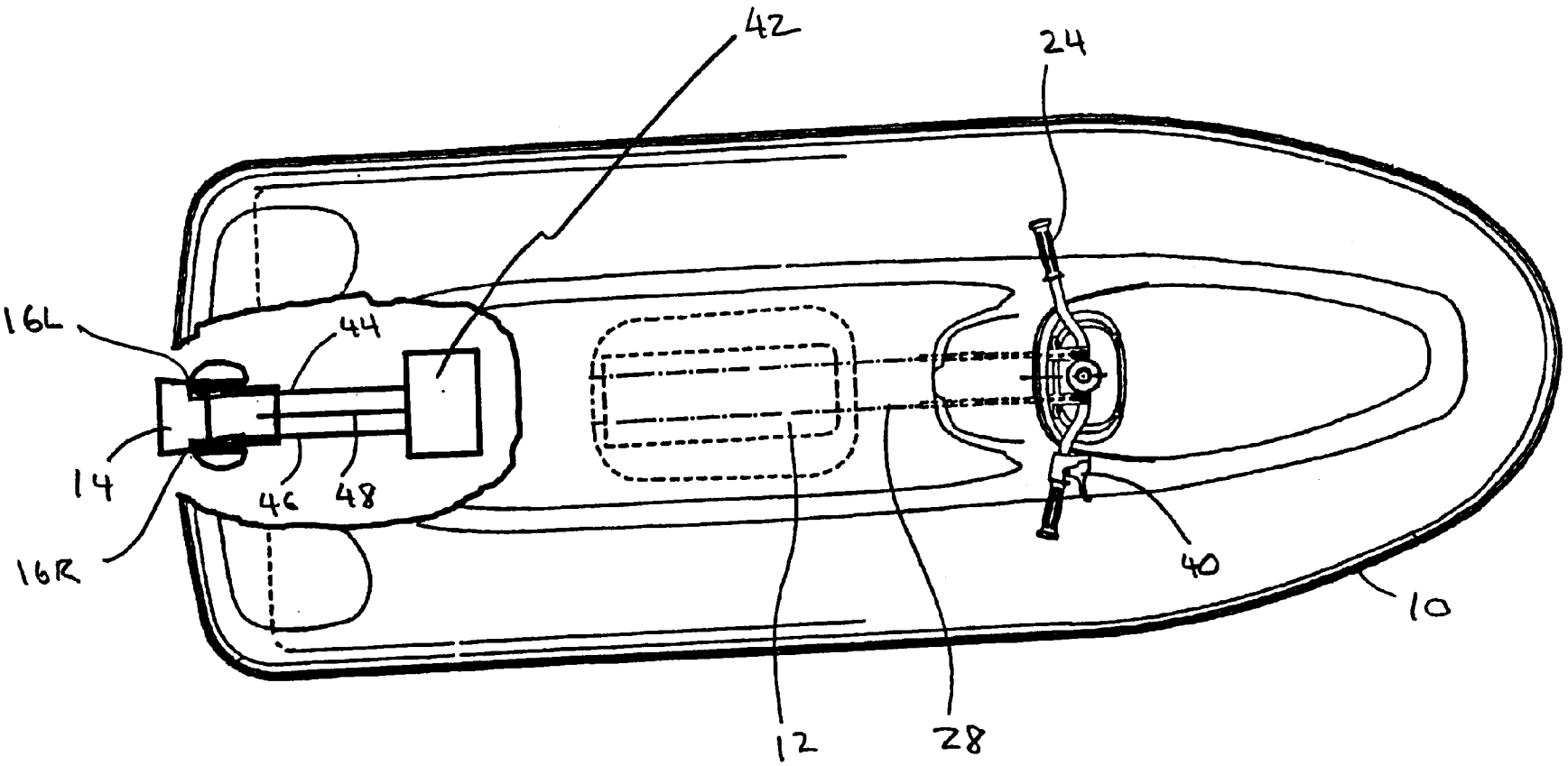
FIG. 2 is a top view with a partial cutaway showing the location of the retractable rudder system according to an embodiment of the present invention.

FIG. 2 is a top view with a partial cutaway showing the location of the retractable rudder system according to an embodiment of the present invention. Mechanical control box 42 is utilized to convert control signals generated by the control circuit in housing 18 to mechanical motion necessary to deploy the rudder system. Cables 44 and 46 are used to deploy a left rudder 16L and a right rudder 16R, respectively. Cable 48 is utilized to release the latching mechanism holding the rudders in the up position prior to deployment. Further details are provided below.

Figure 3:
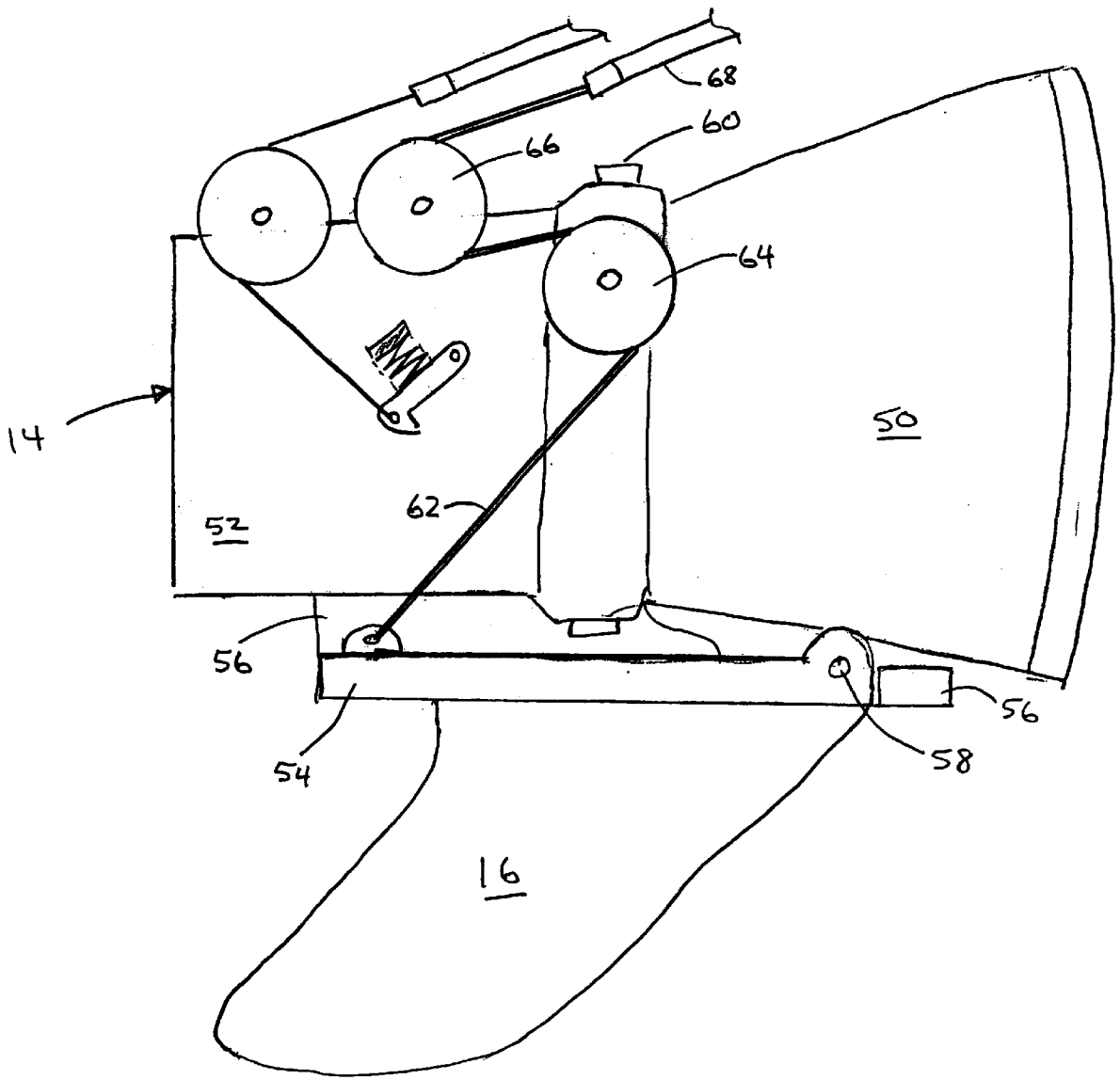
FIG. 3 is a side view of the steering nozzle showing the retractable rudder system in the deployed position according to an embodiment of the present invention.

FIG. 3 is a side view of the steering nozzle 14 showing the retractable rudder system in the deployed position according to an embodiment of the present invention. Aft section 52 of the steering nozzle assembly 14 is connected to the forward section 50 via a pivot attachment 60. Rudder 16 is fixed to base plate 54, which is in turn attached to mounting plate 56 via pin 58. Pin 58 is rotationaly fixed to mounting plate 56. Base plate 54 can freely rotate around pin 58. Pin 58 is also fashioned as to prevent base plate 54 and rudder 16 from moving outward (toward the viewer) and dislodging themselves from assembly 14 as is well known to those skilled in the art. A coil spring (not shown) is wrapped around pin 58. One end of the spring is fixed to mounting plate 56, the other end is fixed to base plate 54. The spring mechanically biases the rudder to the deploy position (shown). A mechanical stop (not shown) may also be provided to prevent the rudder from rotating beyond the horizontal deploy position. The spring constant of the coil spring is chosen to be high enough to deploy the rudder as fast as required, compensating for the friction of the deployment devices, but low enough to allow the rudders to freely retract under any significant external force, and to be retracted and latched by hand. This prevents damage to the rudders if the craft is beached and minimizes damage to wildlife or people unfortunate enough to be run over by the watercraft. Base plate 56 is rigidly affixed to aft section 52 so that rudders are turned coincident with the rotation of the aft section. The steering mechanism (not shown) is generally connected to the aft section of the nozzle assembly via cables 28. The rudder system is lowered into position by cable 62 attached to base plate 54. The cable is guided by pulleys 64 and 66. Cable sheath 68 protects cable 62. The cables allow aft section 52 and rudders 16 to move freely with any steering inputs.

As previously mentioned, this side view shows one of two rudder units. Although mounting plate 56 is common to both left and right rudders, each rudder can pivot independently of the other.

Figure 4:
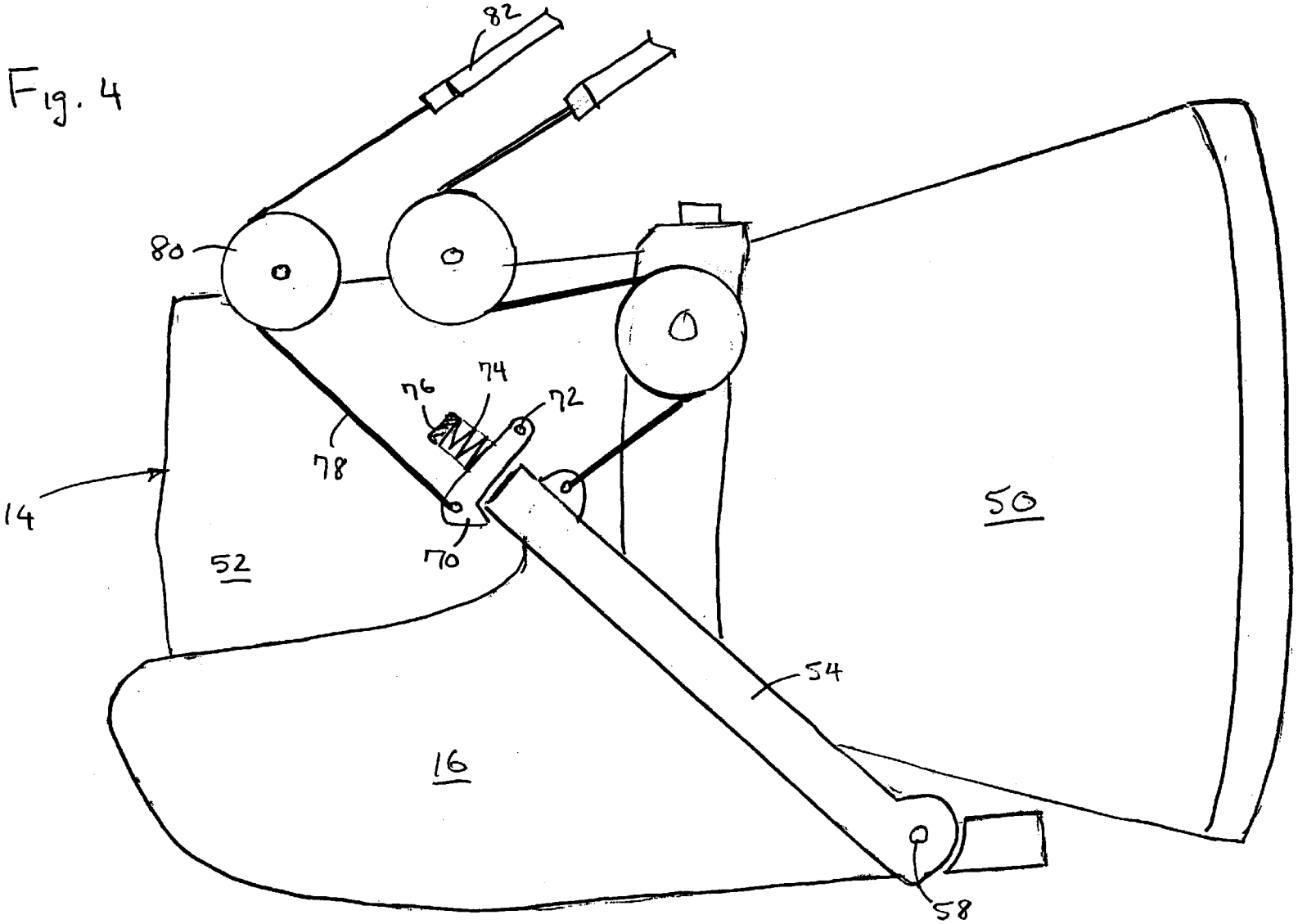
FIG. 4 is a side view of the steering nozzle showing the retractable rudder system in the non-deployed and latched position according to an embodiment of the present invention.

FIG. 4 is a side view of the steering nozzle showing the retractable rudder system in the non-deployed and latched position according to an embodiment of the present invention. Latch 70 pivots via pin 72 and is held against base plate 54 with spring 74. Stop 76, fixed to aft section 52, retains spring 74. Cable 78 is guided by pulley 80. Sheath 82 protects cable 78. Sufficient tension on cable 78 releases the rudder system for deployment. Latch 70 provides positive retainment of the rudder in the retracted position, which avoids the need to have cable 62 perform this task. Cables are less precise and stretch over time, which could allow the rudders to become partially immersed in the water in the retracted position. This will increase drag and potentially produce unstable handling characteristics at high speeds. The latch is designed to hold the rudders completely out of the water stream in the non deploy position, minimizing any impact of this system for the watercraft operating at normal conditions. In the position shown, steering of the craft is unimpeded, and aft section 52 may pivot freely with steering inputs.

Figure 5:
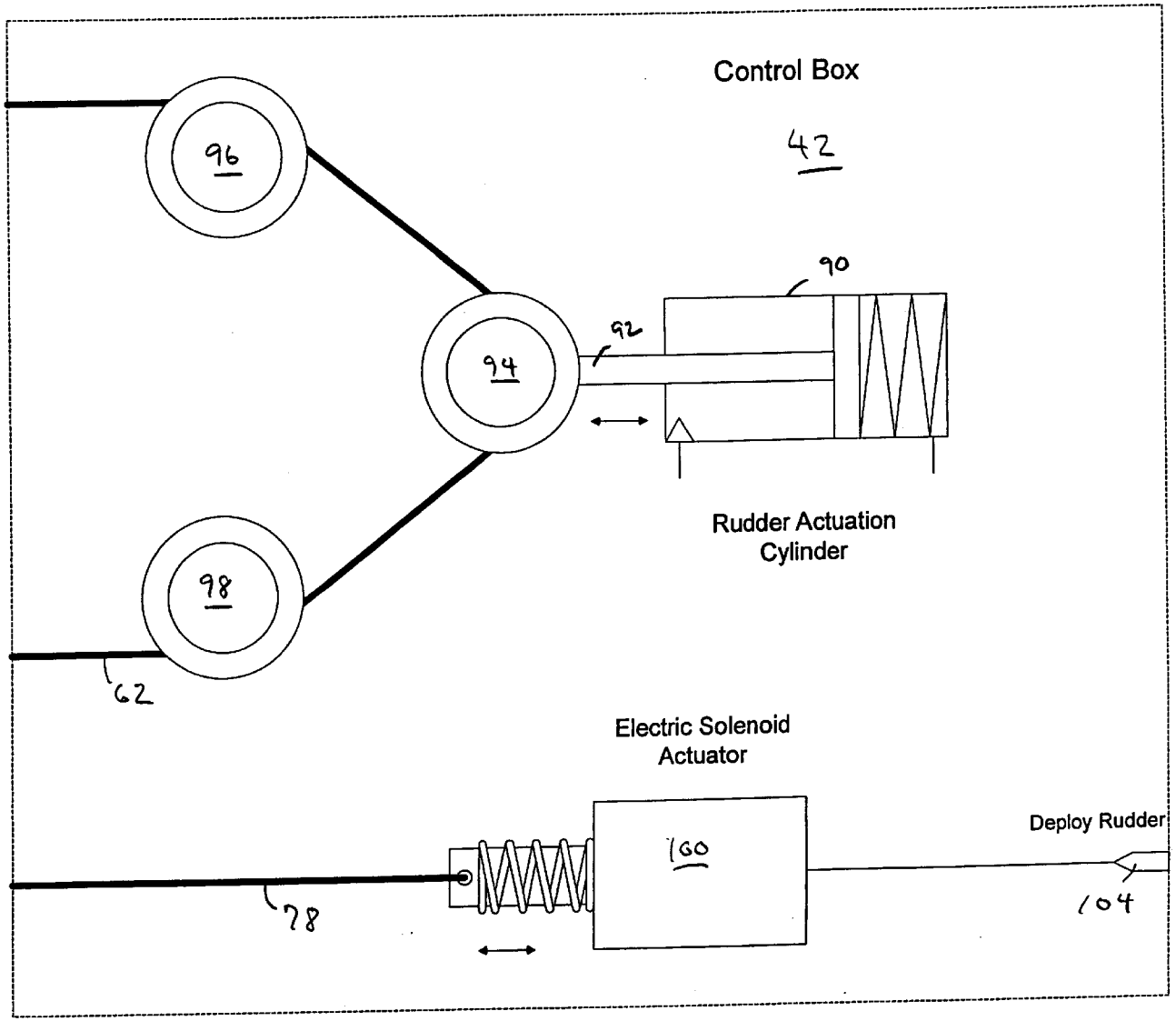
FIG. 5 is a schematic view of the cable operated deployment system according to an embodiment of the present invention.

FIG. 5 is a schematic view of the cable operated deployment system according to an embodiment of the present invention. The cable deployment mechanism is housed within Control Box 42. The deployment of the rudders is controlled hydraulic rudder actuation cylinder 90. Pulley 94 is coupled to linear actuator shaft 92 of cylinder 90. Extension of shaft 92 deploys the rudders. Retraction of shaft 92 retracts the rudders. Increasing fluid pressure supplied to cylinder 90 retracts the rudders. Releasing fluid pressure causes rudders to deploy. Springs inside cylinder 90 and on the rudder assembly previously described insure the deployment of the rudders upon release of the fluid pressure in cylinder 90. Although a hydraulic cylinder is described in this embodiment, it is evident that other cable release mechanisms can be employed, such as pneumatic cylinders, or motor driven linear actuators. Latch 70 is released by pulling on cable 78 with electric solenoid actuator 100. The solenoid is actuated by a voltage supplied at 104 connected to the Deploy Rudder signal output from the control unit. One solenoid is shown in FIG. 5 for clarity, although two may be utilized, one for each rudder assembly. Alternatively, latch 70 may be mechanically coupled for left and right rudders, or a "Y" splice provided for cable 78, each of the two termination ends of the "Y" being connected to the left and right latches.

Figure 6:
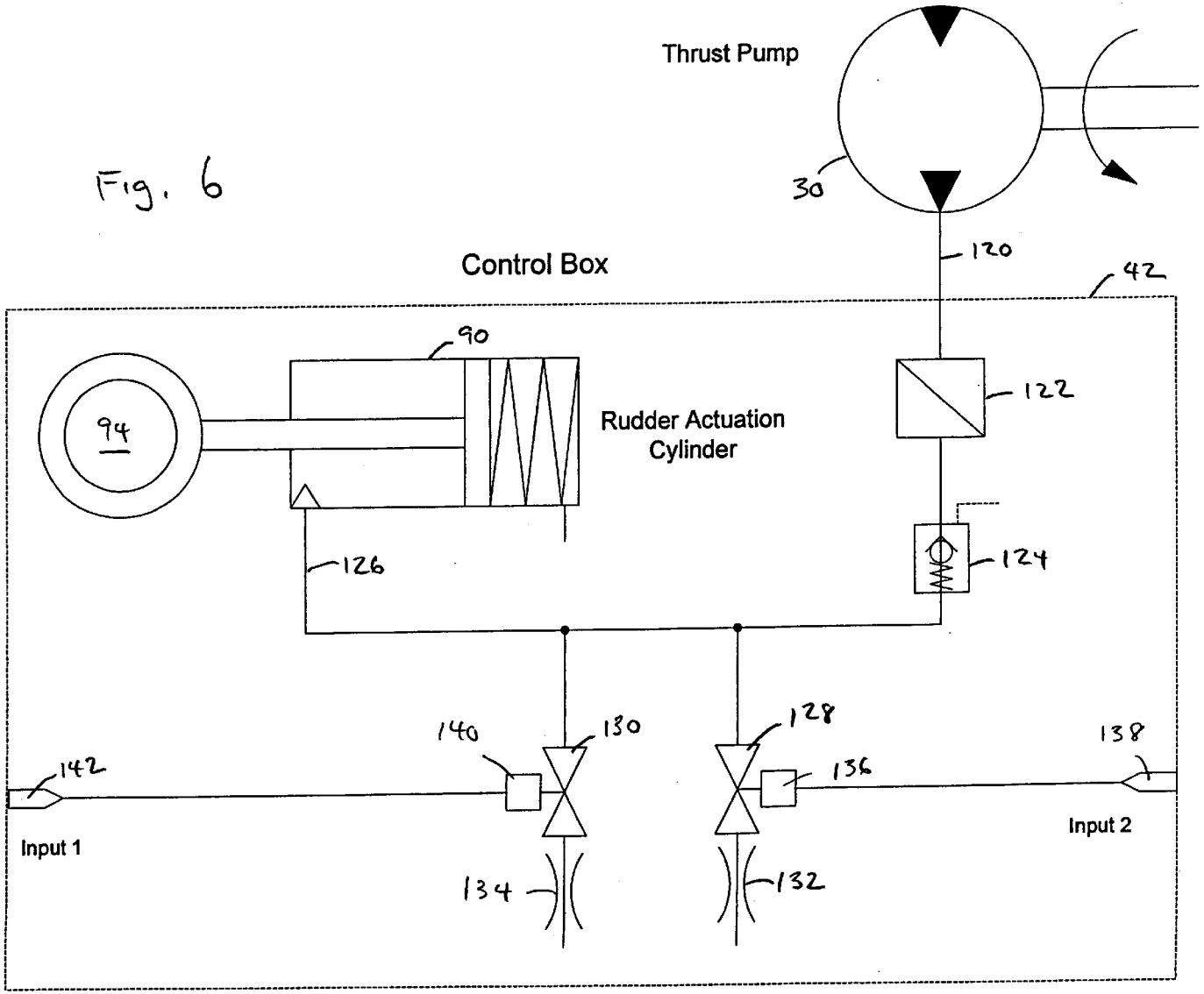
FIG. 6 is a schematic view of the hydraulic circuit for controlling the rate of deployment of the rudders according to an embodiment of the present invention.

FIG. 6 is a schematic view of the hydraulic circuit for controlling the rate of deployment of the rudders according to an embodiment of the present invention. Hydraulic fluid pressure is supplied by Thrust Pump 30 (also known as a jet pump), which propels the boat. Line 120 delivers fluid to the control box 42, and is coupled to filter 122 inside the box. Fluid pressure is delivered to cylinder 90 via line 126. Check valve 124 maintains fluid pressure in cylinder 90 if feed pressure from the pump 30 drops off. Solenoid valves 128 and 130, coupled to restrictors 132 and 134 provide controlled bleed down of the cylinder pressure and allow a controlled deployment rate of the rudder system. Restrictor 132 allows a higher flow rate than restrictor 134 for the same pressure drop condition. A voltage input applied through input 1 (ref 142) opens valve 130 via actuator 140. A voltage input applied through input 2 (ref 138) opens valve 128 via actuator 136. With both valves open (inputs 1 and 2 high), the bleed down rate is the highest, resulting in the fastest rudder deployment rate. Input 2 high and input 1 low results in an intermediate deployment rate, and input 1 high, input 2 low results in the slowest deployment rate.

Figure 7:
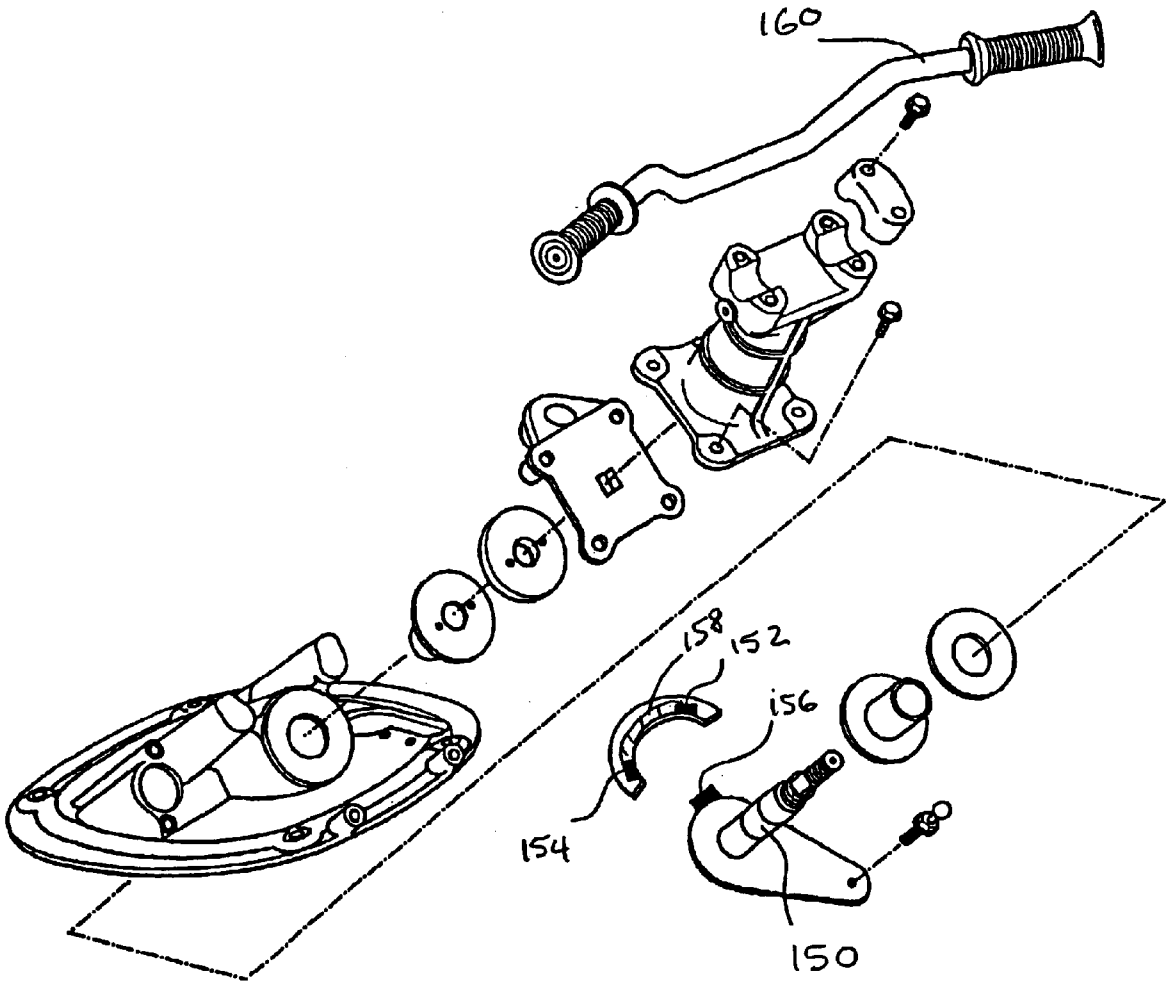
FIG. 7 is an assembly diagram of the steering components including the steering position sensor according to an embodiment of the present invention.

FIG. 7 is an assembly diagram of the steering components including the steering position sensor according to an embodiment of the present invention. Steering input to bar 160 causes shaft 150 to rotate. A steering position sensor is comprised of components 152, 154, 156, and 158. Components 152, 154, and 158 are mounted on a structure fixed to the hull, whereas component 156 is mounted to the steering shaft 150. Components 152 and 154 are sensors positioned and the left and right ends of the allowed travel (steering lock sensors). Component 158 is a linear sensor element that allows the position of the steering to be determined at any intermediate steering position. These components may be implemented as a sliding contact (156) over a resistor element (158) for example, or may be any of a number of other systems well known to those skilled in the art. Other choices may be optical or magnetic. Signals from the steering position sensor are sent to the control unit in housing 18 for further processing.

Figure 8:
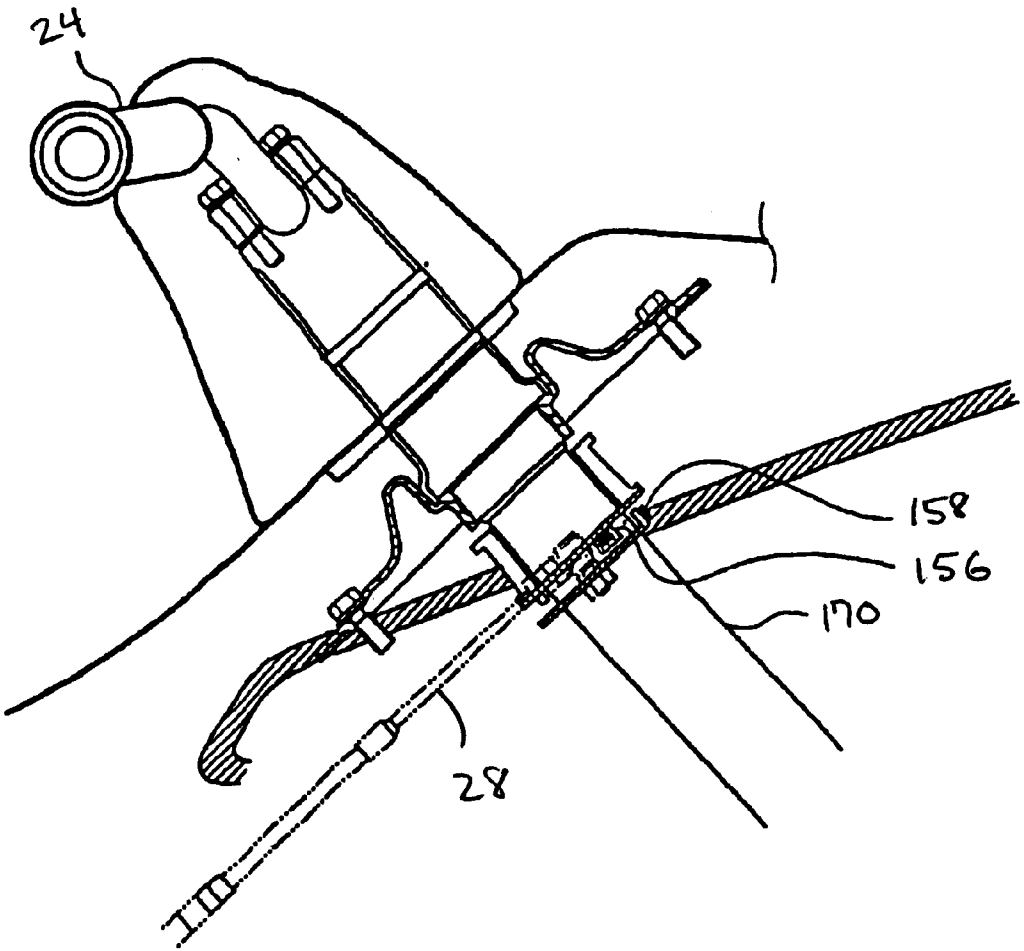
FIG. 8 is a cutaway side view of the steering system according to an embodiment of the present invention.

FIG. 8 is a cutaway side view of the steering system according to an embodiment of the present invention. Cable 28 transmits the steering input to the rudder/nozzle system previously described. Also shown are the components for the steering position sensors 156 and 158 mounted on steering column 170.

Figure 9:
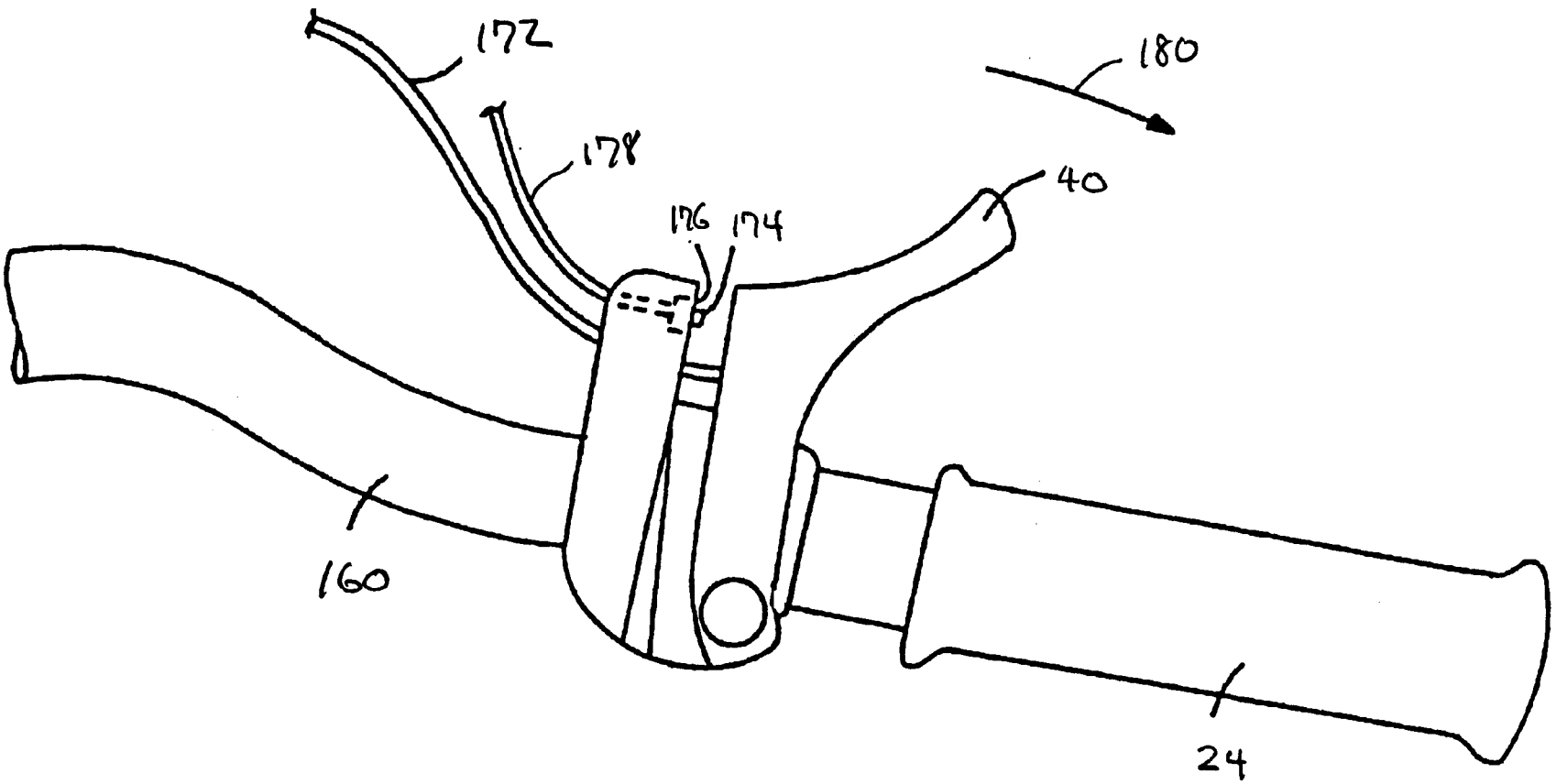
FIG. 9 is a top view of the throttle control and OFF position throttle sensor according to an embodiment of the present invention.

FIG. 9 is a top view of the throttle control and OFF position throttle sensor according to an embodiment of the present invention. The pilot increases the throttle by pulling lever 40 in the direction indicated by arrow 180, while holding grip 24. The throttle "OFF" condition is detected by sensor components 174 and 176, which are actuated when throttle lever 40 is in the rest position (shown). Signals are transmitted to the control unit via electrical cable 178. Mechanical cable 172 is coupled to the throttle on the motor driving the jet pump. Sensor components 174, 176 can be a microswitch, an magnetic position detector, or an optical sensor.

Figure 10:
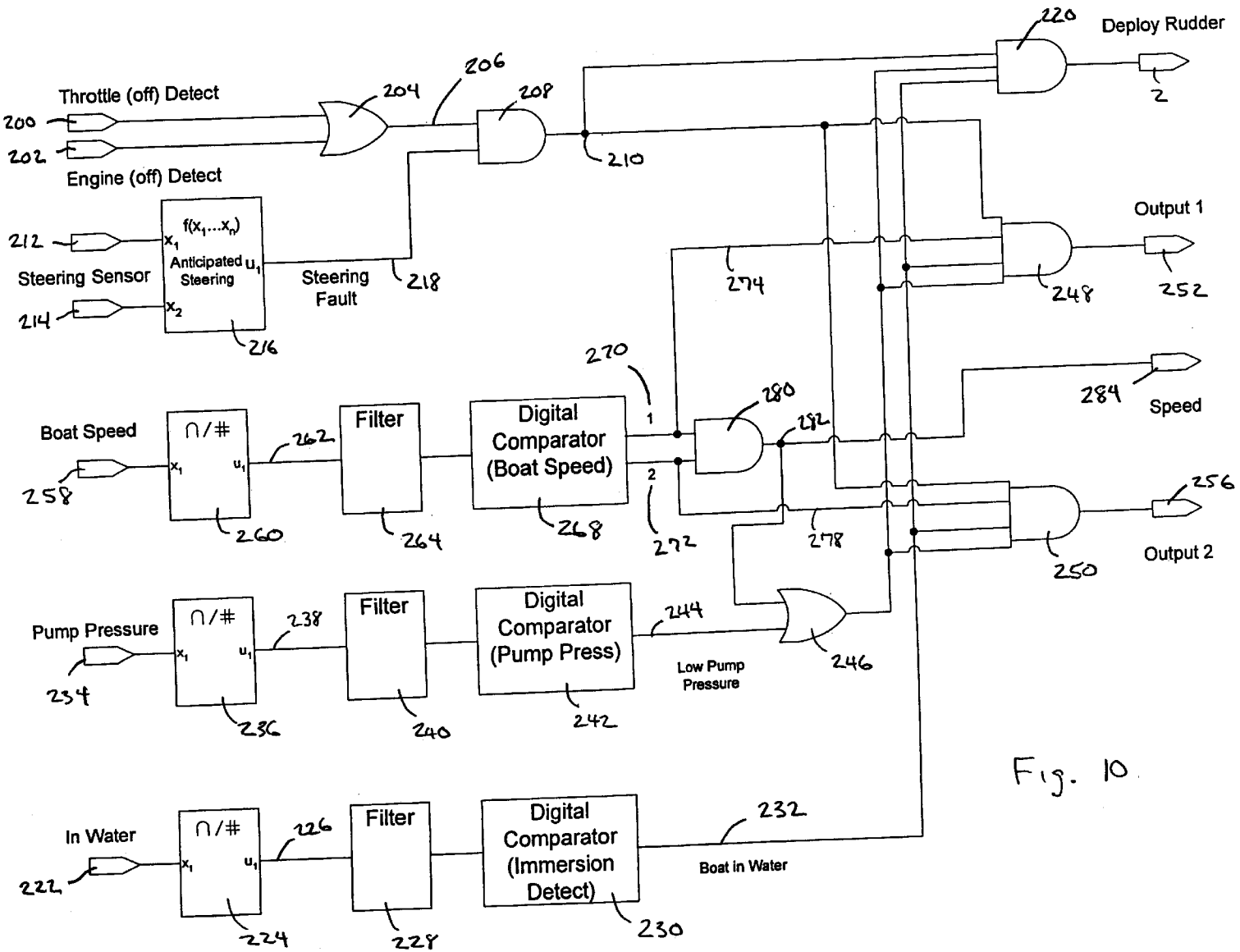
FIG. 10 is a circuit schematic of the rudder deployment control system according to an embodiment of the present invention.

FIG. 10 is a circuit schematic of the rudder deployment control system according to an embodiment of the present invention. Throttle "OFF" position sensors 174, 176 are coupled to the control system at input 200. An engine "OFF" sensor input is applied at 202. The engine "OFF" input may be supplied by a separate rpm sensor mounted on the motor, or from an output supplied by the onboard engine management system. Inputs 200 and 204 are supplied to both inputs of a dual input OR gate 204. The output of gate 204 is supplied to one input of a dual input AND gate 208. Steering sensor position information is supplied to inputs 212 and 214. These inputs are supplied to the Anticipated Steering Module 216 which determines whether a steering fault condition exists. The steering fault output 218 is supplied to the second input of AND gate 208. The output 210 of gate 208 is supplied to the inputs of AND gates 220, 248, and 250. To deploy the rudder system, output 210 must be logic level "high", which means that a steering fault from module 216 and either a throttle "OFF" or engine "OFF" condition must exist.

The immersion detector 20 output is connected to the controller at input 222. This sensor determines if the boat is in the water. The input is fed to A/D (analog to digital) converter 224, then digitally filtered by filter 228, and fed to digital comparator 230. If the boat is in the water, a logic "high" signal is generated at output 232, which is supplied to the inputs of AND gates 220, 248, and 250. In order to deploy the rudder system, the boat must be in the water, in addition to the conditions required and described above.

Pump pressure generated by the thrust (or jet) pump is measured by a transducer and coupled to the control system at input 234. A/D converter 236 digitizes the signal which is subsequently filtered by 240. A digital comparator produces a logic "high" signal for pump pressures below a predetermined minimum value. The comparator output 244 is supplied to one input of OR gate 246. The output of OR gate 246 is applied to the inputs of AND gates 220, 248, 250. A pump pressure below the minimum programmed is sufficient to enable the rudder deployment via AND gate 220.

The boat speed sensor 22 is coupled to the control system at input 258. A/D converter 260 digitizes the signal which is filtered by 264 and supplied to comparator 268. Comparator 268 produces two outputs depending on the boat speed. Output 1 (ref 270) is logic "high" for speeds over 40 mph. Output 2 (ref 272) is logic "high" for speeds between 20 and 40 mph. Outputs 1 and 2 are logic "high" for speeds below 20 mph. Outputs 270 and 272 are applied to the inputs of a dual input AND gate 280. Output 1 (ref 270) is also applied to AND gate 248 via connection 274. Output 2 (ref 272) is applied to AND gate 250 via connection 278. The output 282 of AND gate 280 is fed to one input of OR gate 246, as well as control system Speed output 284. For the case of speeds below 20 mph, output 284 is logic "high". Additionally, for speeds below 20 mph, rudder deployment is enabled irrespective of jet pump pressure. For any speed above 20 mph, the pump pressure must be below the threshold value to enable the rudder deployment via gate 220.

Output 1, ref 252, is logic "high" when all the requirements for rudder deployment are met (AND gate 220 output is logic "high"), and output 270 of comparator 268 is "high". Output 2, ref 256, is logic "high" when all the requirements for rudder deployment are met (AND gate 220 output is logic "high"), and output 272 of comparator 268 is "high". There is no logic state when outputs 270 and 272 are both logic "low".

A process flow diagram further describing the operation of the control system is shown below in FIGS. 13 and 14.

Figure 11:
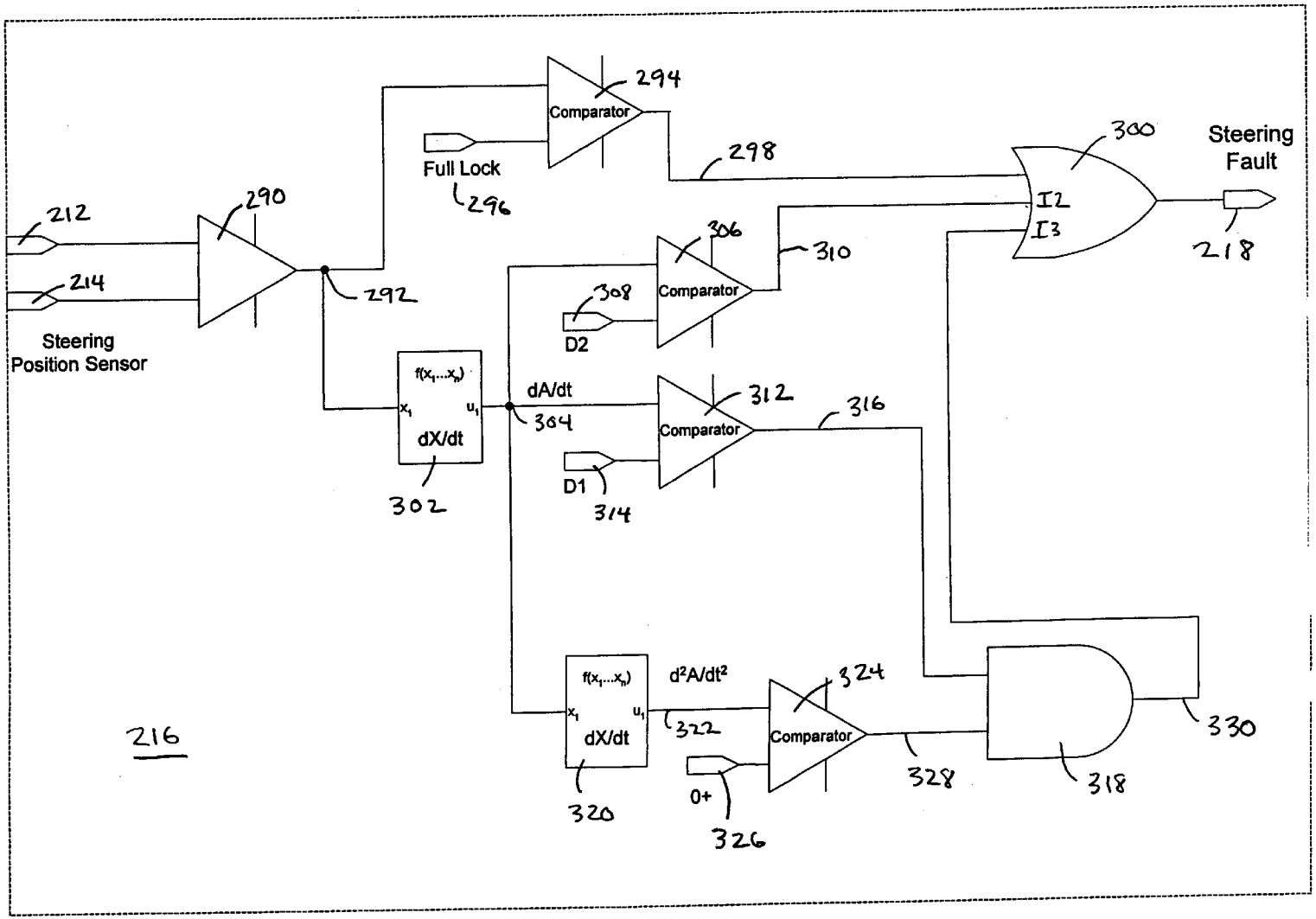
FIG. 11 is a circuit schematic of the Anticipated Steering Module shown in FIG. 10 according to an embodiment of the present invention.

FIG. 11 is a circuit schematic of the Anticipated Steering Module 216 shown in FIG. 10 according to an embodiment of the present invention. Steering position sensor output is connected to module 216 via inputs 212 and 214. Buffer amplifier 290 is used to scale and isolate the incoming signal, and may perform signal conditioning, if required. In one embodiment of the present invention, steering position is provided as an angular displacement from "straight ahead", or 0 degrees. At either left or right full lock, the steering angle is at a maximum. Turning left or right from straight ahead produces the same positive signal, that is maximum at the lock position. Thus, then sensor produces an output representative of angular steering position, in degrees from center. Output 292 from buffer amplifier 290 is fed to comparator 294. An analog comparator is shown, but a digital version could be easily substituted with no loss in functionality. Input 296 to comparator 294 represents the signal level corresponding to the full lock steering position. At full lock, comparator 294 output signal 298 is logic "high". Output 298 is coupled to one input of three input OR gate 300. A logic level "high" from comparator 294 is passed through OR gate 300 to output 218 as a Steering Fault "high" output.

Buffered signal 292 is also coupled to derivative function module 302, which computes the time derivative of the steering angle information from the sensor. If A(t) represents the steering angle input (in degrees position from center), then dA(t)/dt is computed and present at output 304. An analog derivative function module is shown, however a digital implementation is also possible. Output 304 is coupled to the input of comparator 306. Values of dA/dt greater that a predetermined level D2, supplied to the reference input 308 of comparator 306, cause 306 to output logic "high" at output 310. Output 310 is fed to input I2 of gate 300. A logic "high" at 310 is passed through gate 300 as a Steering Fault "high" at output 218. This logic provides a steering fault for an operator turning the steering mechanism toward lock at a rate higher than a predetermined level D2. In this way, the circuit is anticipating a steering action that could be the result of a collision avoidance maneuver, and action is being taken to deploy the rudder system before the steering angle reaches the lock position.

Output 304 from differentiator 302 is also fed to comparator 312, where it is compared to a predetermined value of D1 supplied to reference input 314. The value of D1 is generally less than the value of D2 described above. In addition, output 304 is coupled to a second differential module 320, which computes the second time derivative of A(t). Output 322 is therefore $d^2A(t)/dt^2$, which represents the acceleration of the steering angle input for positive values of output 322. Output 322 is coupled to the input of comparator 324, where values above zero result in a logic "high" at output 328. The zero reference level is fed to comparator 324 at input 326. Outputs 316 and 328 are coupled to a dual input AND gate 318. The output of gate 318 will attain logic "high" if both levels at 316 and 328 are "high". Output 330 of gate 318 is coupled to the I3 input of OR gate 300. A logic "high" from gate 318 results in a Steering Fault "high" output This requires the condition that dA(t)/dt exceed level D1 and $d^2A(t)/dt^2$ be greater than zero. In other words, the pilot is exceeding a particular steering rate toward lock, and accelerating. This is a second criteria which may indicate a response to collision avoidance, which results in potential deployment of the rudder system prior to reaching lock on the steering.

Figure 12:
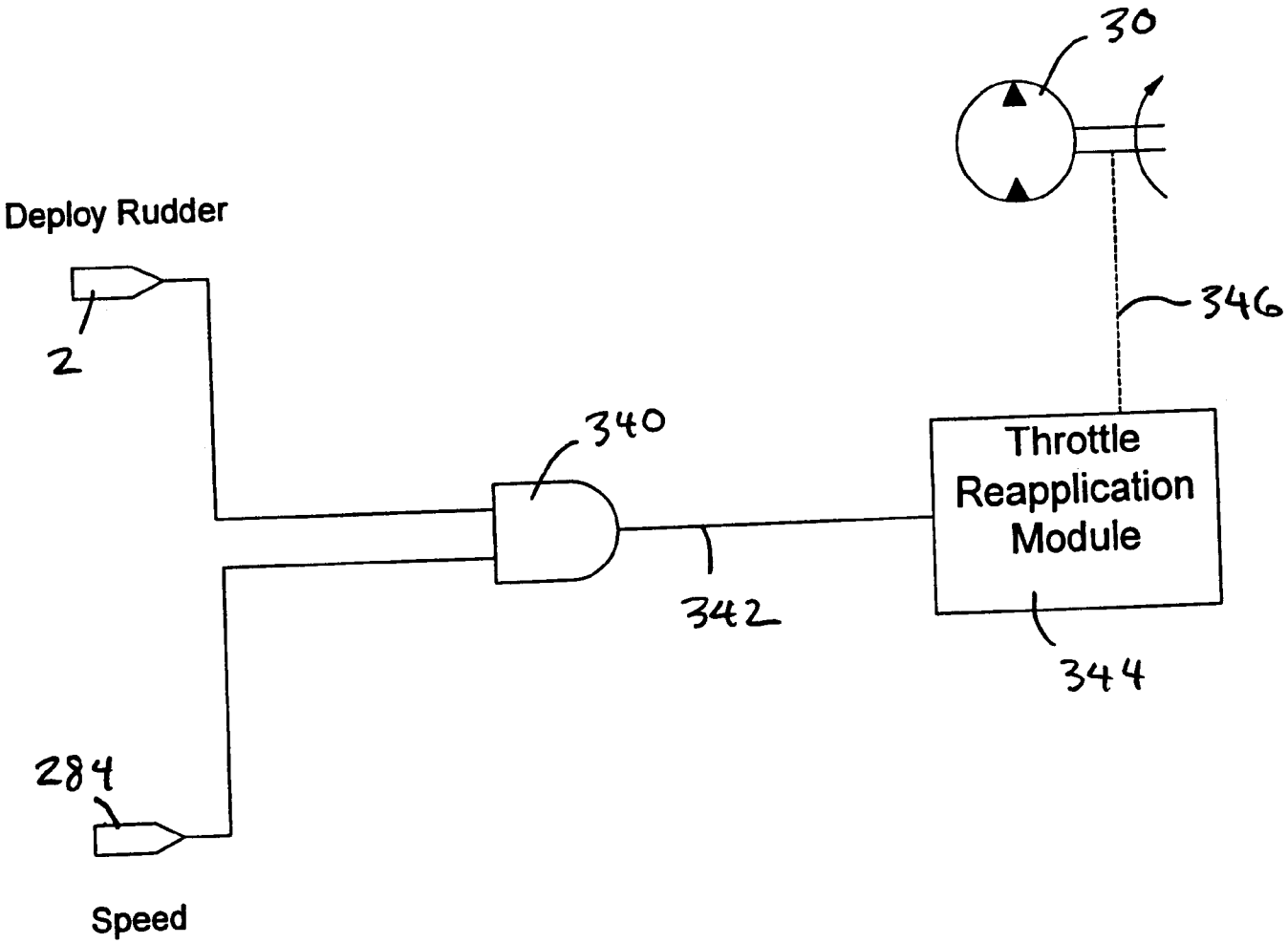
FIG. 12 is a circuit schematic for Throttle Reapplication according to an embodiment of the present invention.

FIG. 12 is a circuit schematic for Throttle Reapplication according to an embodiment of the present invention. Throttle reapplication will be engaged if the boat speed is below 20 mph and the rudders are deployed. The Deploy Rudder output 2 and Speed output 284 from FIG. 10 is coupled to both inputs of a dual input AND gate 340. The output 342 is coupled to a control module for Throttle Reapplication 344. A logic "high" signal at 342 enables throttle reapplication. The configuration and operation of module 344 is well known to those skilled in the art. Module 344 overrides the pilot operated throttle shown in FIG. 9 to produce a minimum amount of thrust through the jet pump to allow steering control. Module 344 is coupled to jet pump (thrust pump) 30 via connection 346. Connection 346 can be electronic (wire to engine management computer or sensor) or mechanical (a cable or linkage to carburetor or fuel injection throttle body).

Figure 13:
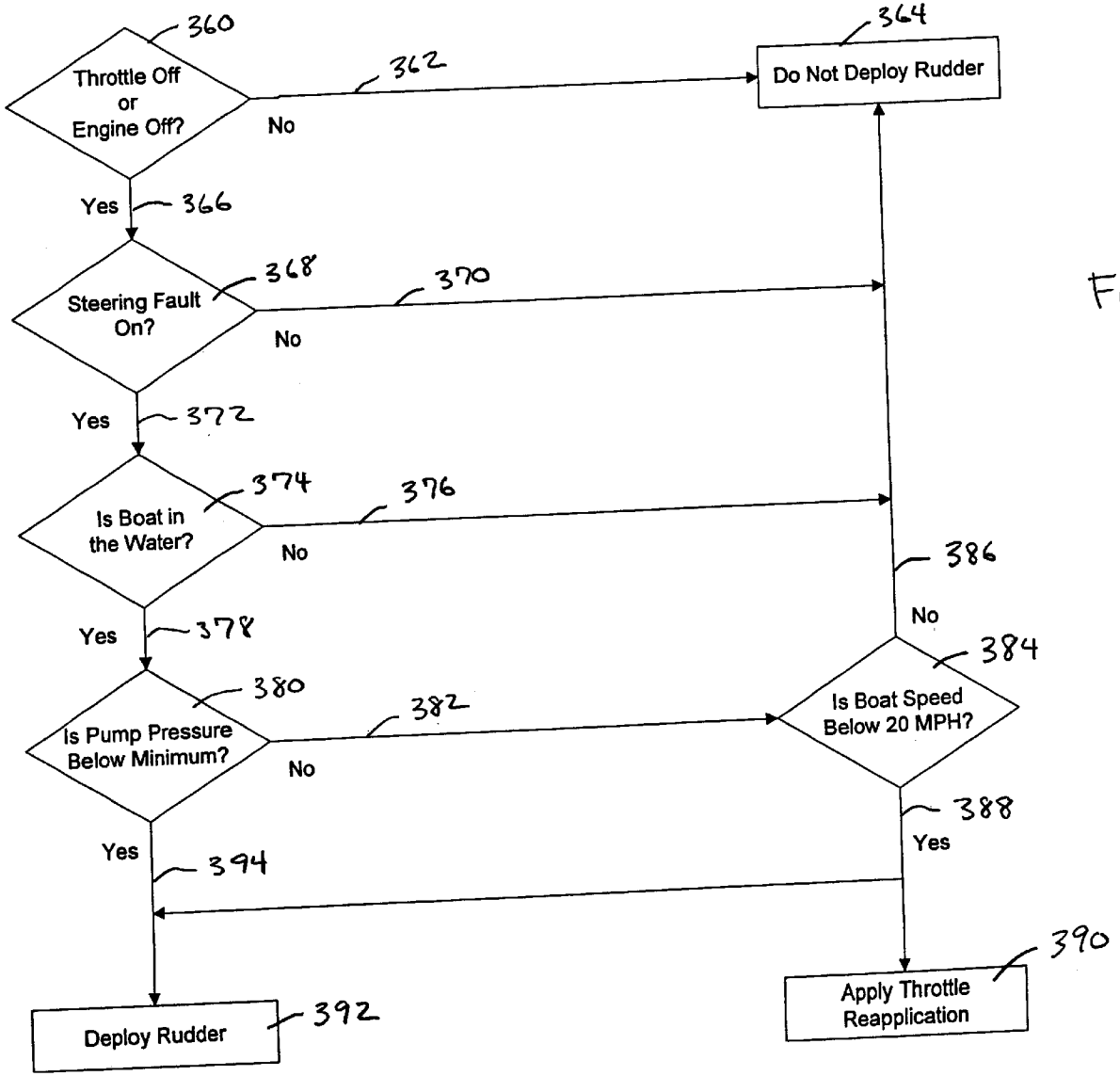
FIG. 13 is a process flow diagram for the control circuit of FIG. 10.

FIG. 13 is a process flow diagram for the control circuit of FIG. 10. Starting at step 360, throttle and engine status are determined. If the throttle or engine are off, the YES branch 366 is followed to step 368. If both the throttle and engine are on, then branch 362 is followed to step 364, and the rudder system is not deployed. At step 368, if a steering fault is "ON" (logic "high"), then YES branch 372 is followed to step 374. At step 368, if no steering fault is present, then branch 370 is followed and the rudder system is not deployed. At step 374, if the boat is in the water, the YES branch is followed to step 380. If the boat is not in the water, branch 376 is followed and the rudder system is not employed. At step 380, if the pump pressure is below the minimum level, branch 394 is followed and the rudder system is deployed. If the pump pressure is above the minimum, path 382 is taken to step 384. If the boat speed is below 20 mph, then path 388 is taken to steps 390 and 392, and the rudder system is deployed as well as throttle reapplication. If the boat speed is above 20 mph, at step 384, path 386 is taken and the rudder system is not deployed.

Figure 14:
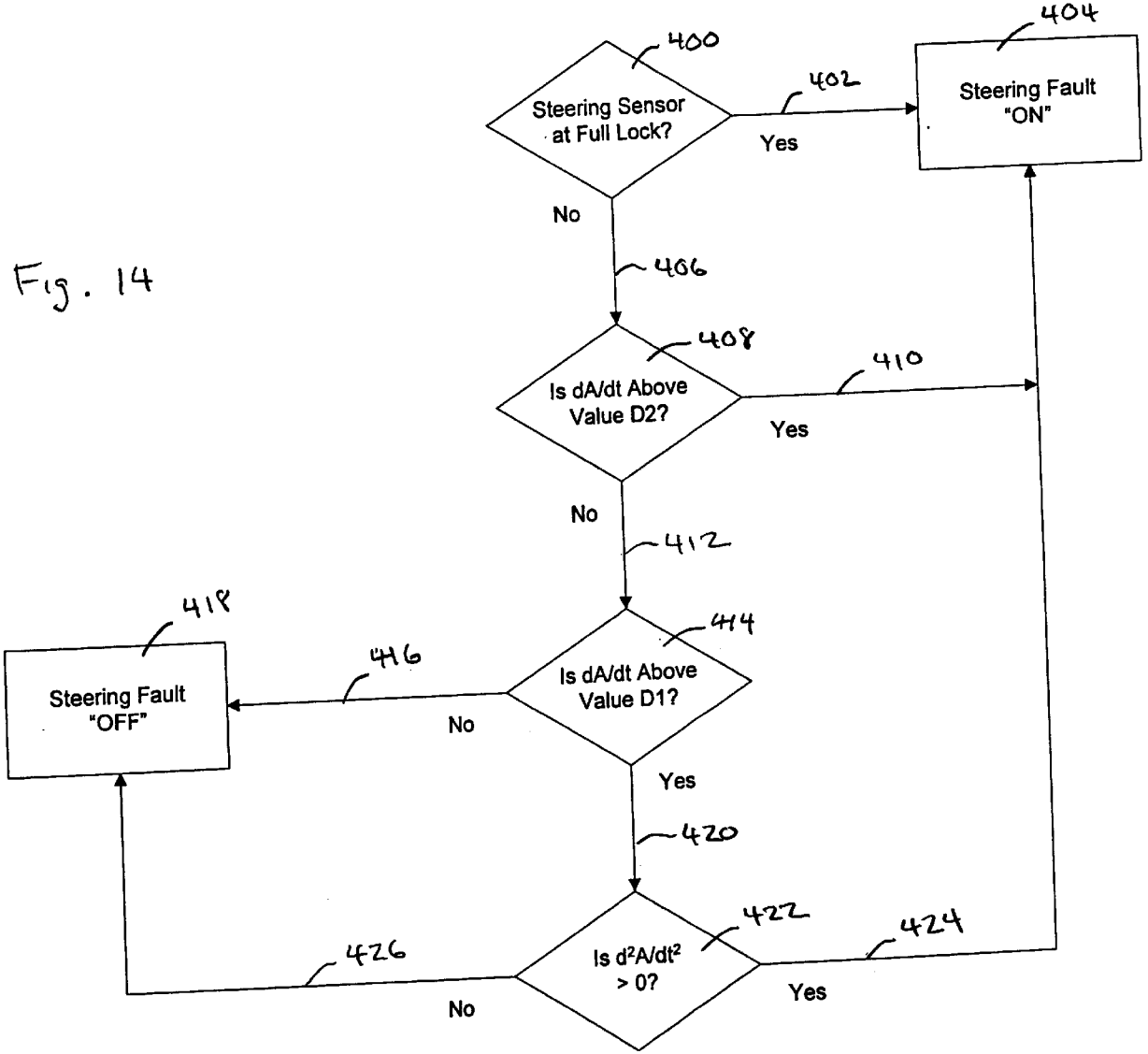
FIG. 14 is a process flow diagram for the Anticipated Steering Module of FIG. 11.

FIG. 14 is a process flow diagram for the Anticipated Steering Module of FIG. 11. Starting at step 400, if the steering sensor is at full lock, branch 402 is followed to step 404, and the steering fault output is "ON". If the steering sensor is not at full lock, branch 406 leads to step 408. In step 408, if the first time derivative of steering angle is above predetermined value D2, then branch 410 is followed to step 404 and the steering fault output is "ON". If step 408 is not true, then branch 412 is followed to step 414. In step 414, if the first time derivative of steering angle is above predetermined value D1, then branch 420 leads to step 422. If dA/dt is not above value D1, then branch 416 leads to step 418, and the steering fault output is "OFF". At step 422, if the second derivative of steering angle with respect to time is greater than zero, then branch 424 leads to step 404 and the steering fault is "ON". If not, branch 426 is followed to 418 and the steering fault is "OFF".

Figure 15:
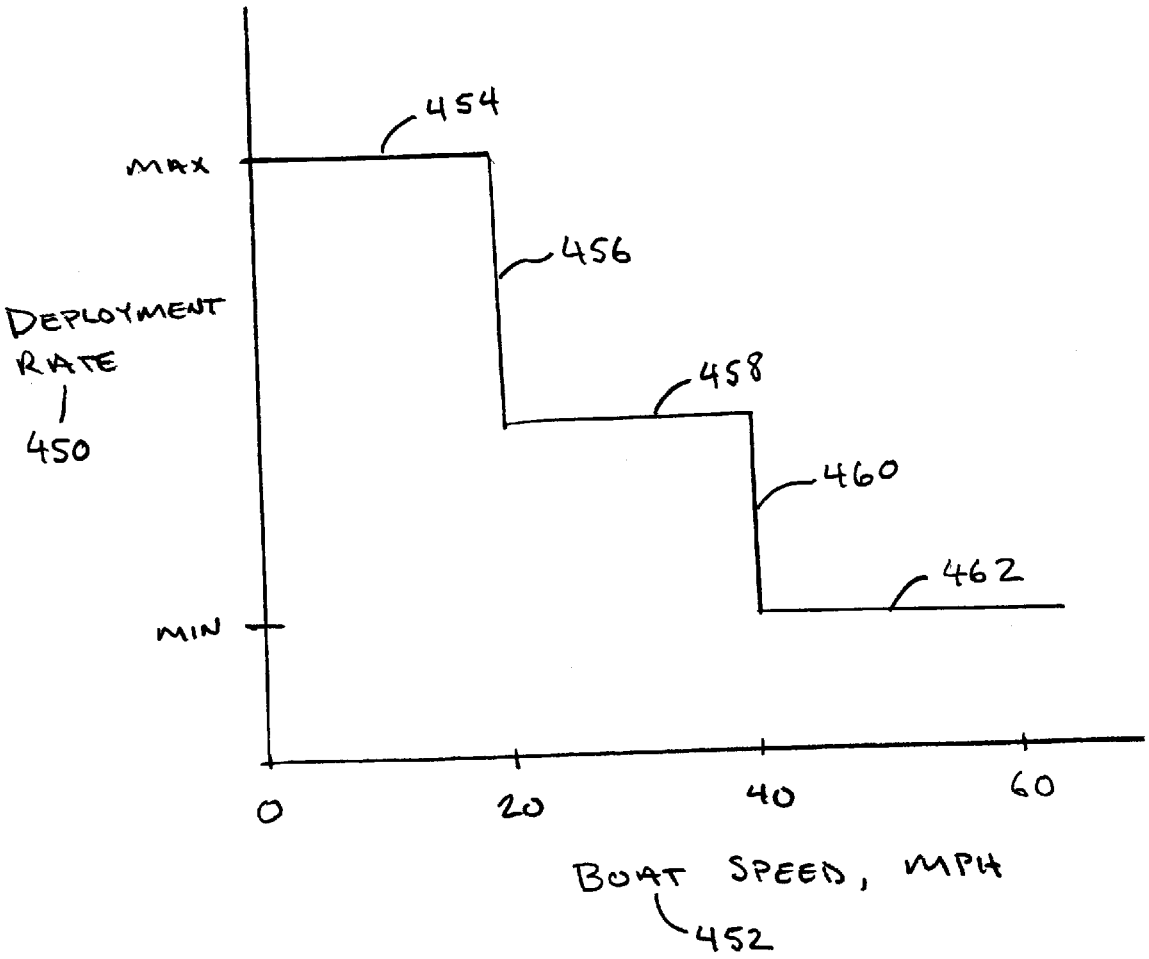
FIG. 15 is a graph of rudder deployment rate as a function of boat speed according to an embodiment of the present invention.

FIG. 15 is a graph of rudder deployment rate 450 as a function of boat speed 452 according to an embodiment of the present invention. The maximum deployment rate 454 is utilized at boat speeds between zero and 20 mph (ref 456). This is produced by the control system when Output 1 (ref 252) and Output 2 (ref 256) are ON or "high". As explained above in FIG. 6, this condition produces the highest bleed down rate of cylinder 90 and therefore the fastest rudder deployment. An intermediate deployment rate 458 is achieved for boat speeds between 20 mph (ref 456) and 40 mph (ref 460), with only Output 2 ON. The minimum deployment rate is achieved at 462 for boat speeds above 40 mph, and corresponds to Output 1 ON only. This condition is created by the bleed down of cylinder 90 through the highest restriction in FIG. 6.

Figure 16A:
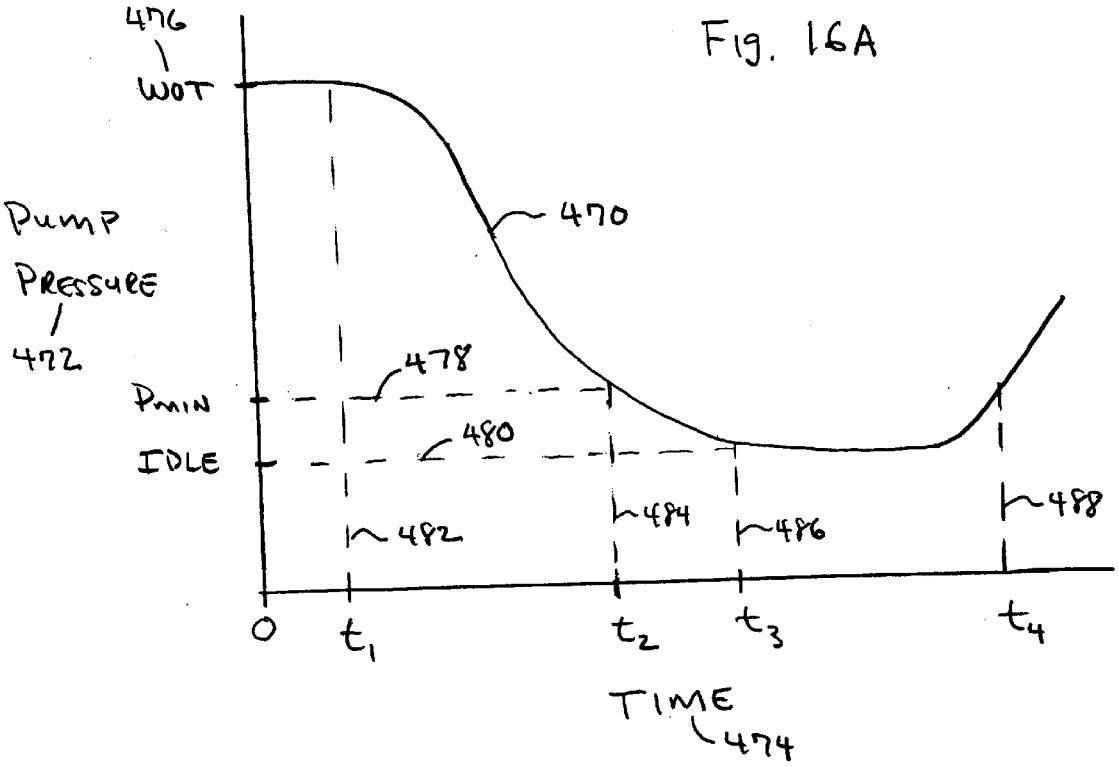
FIG. 16A is a timing diagram of thrust pump pressure following throttle release.

FIG. 16A is a timing diagram of thrust pump pressure 472 following throttle release. In this figure, curve 470 shows the thrust (or jet) pump pressure after the throttle is rapidly closed from a wide open throttle (WOT) condition. The maximum pump pressure at WOT is shown at 476. At time $t_1$ (ref 482) the throttle is closed. The pressure 470 drops to $P_{min}$ at 478 and $t_2$ (ref 484). The lowest pressure 480 is achieved at idle condition at $t_3$. The throttle is reapplied at 488, $t_4$.

Figure 16B:
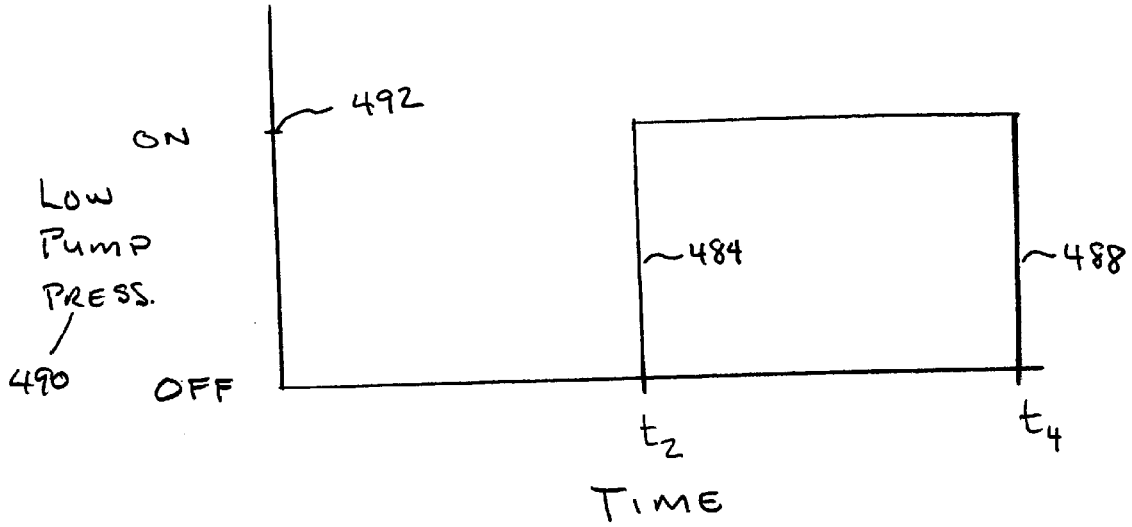
FIG. 16B is a timing diagram of the Low Pump Pressure output signal of FIG. 10 as a function of the throttle release shown in FIG. 16A according to an embodiment of the present invention.

FIG. 16B is a timing diagram of the Low Pump Pressure 490 output signal of FIG. 10 as a function of the throttle release shown in FIG. 16A according to an embodiment of the present invention. As shown in FIG. 16A, the jet pump pressure is below $P_{min}$ between time $t_2$ and $t_4$. For this time period, the output signal is logic "high" (ref 492).

FIGS. 17A–E show the steering fault output for the anticipated steering module shown in FIGS. 10 and 11 as a function of example values for A(t) and its first and second time derivatives.

Figures 17A, 17B, 17C, 17D, 17E:
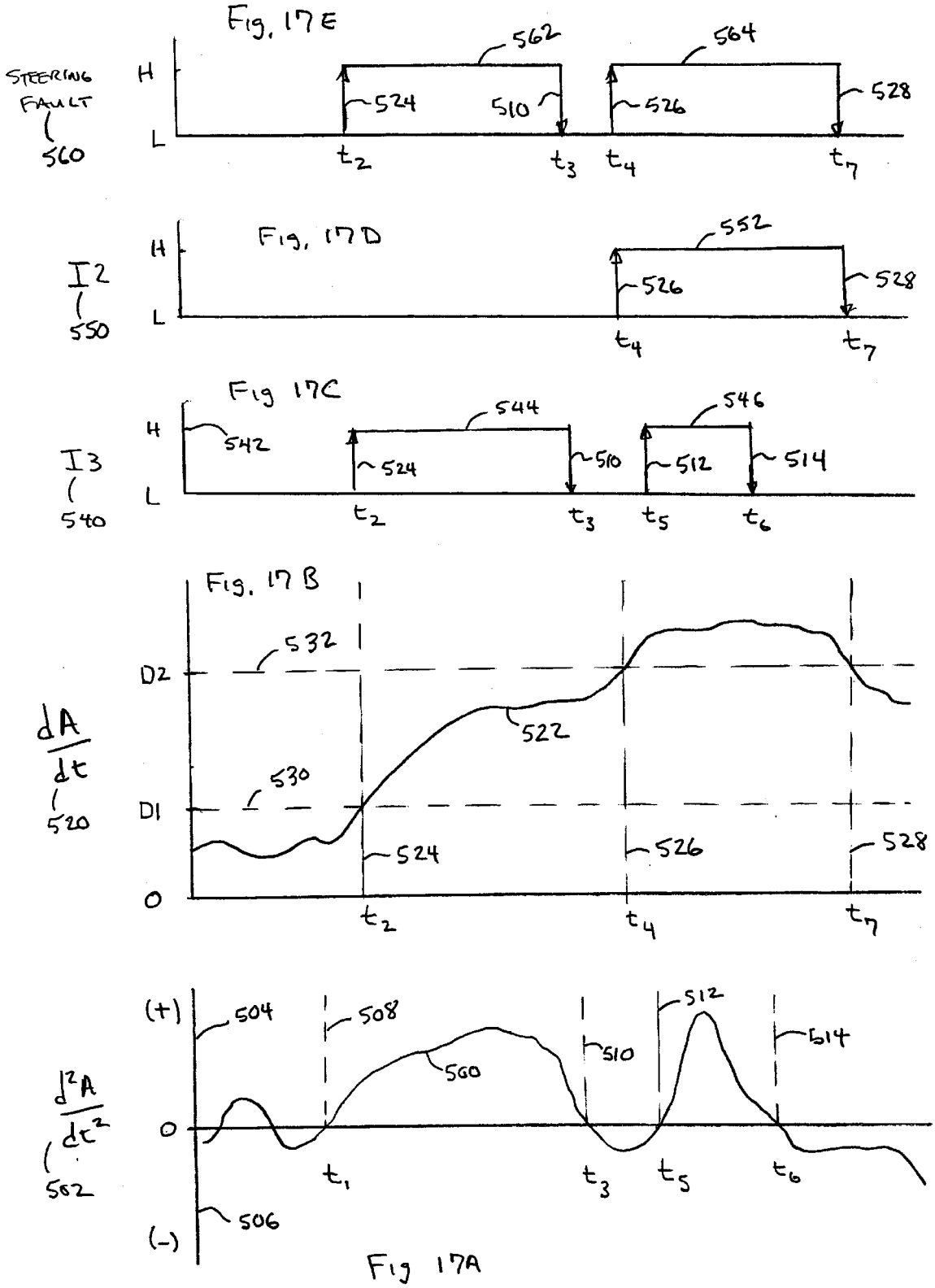
FIG. 17A is a timing diagram of the second derivative of steering angle with respect to time for an example steering event.
FIG. 17B is a timing diagram of the first derivative of steering angle with respect to time for the example steering event shown in FIG. 17A.
FIG. 17C is a timing diagram of OR gate input I3 (of FIG. 11) for the example steering event of FIGS. 17A, 17B according to an embodiment of the present invention.
FIG. 17D is a timing diagram of OR gate input I2 (of FIG. 11) for the example steering event of FIGS. 17A, 17B according to an embodiment of the present invention.
FIG. 17E is a timing diagram of the Steering Fault output (of FIG. 11) for the example steering event of FIGS. 17A, 17B, 17C, and 17D according to an embodiment of the present invention.

FIG. 17A is a timing diagram of the second derivative of steering angle with respect to time 502 for an example steering event. In this plot 500 the second derivative is plotted as a function of time for positive values 504 and negative values 506. In the region between $t_1$ (ref 508) and $t_3$ (ref 510) the second derivative is greater than zero. Also, in the region between $t_5$ (ref 512) and $t_6$ (ref 514) the second derivative is greater than zero.

FIG. 17B is a timing diagram of the first derivative of steering angle with respect to time for the example steering event shown in FIG. 17A. In this plot 522, the first derivative is plotted as a function of time. At time $t_2$ (ref 524), dA/dt exceeds level D1 (ref 530). At $t_4$ (ref 526) dA/dt exceeds level D2 (ref 532), and remains above D2 until $t_7$ (ref 528).

FIG. 17C is a timing diagram of OR gate input I3 (of FIG. 11) for the example steering event of FIGS. 17A, 17B according to an embodiment of the present invention. I3 (ref 540) will be "high" 542 for dA/dt above D1 and the second derivative 502>zero. These conditions are met starting at $t_2$ and ending at $t_3$ (ref 544). They are also met between $t_5$ and $t_6$ (ref 546).

FIG. 17D is a timing diagram of OR gate input I2 (of FIG. 11) for the example steering event of FIGS. 17A, 17B according to an embodiment of the present invention. I2 (ref 550) will be "high" for time segment 552 between $t_4$ and $t_7$.

FIG. 17E is a timing diagram of the Steering Fault output (of FIG. 11) for the example steering event of FIGS. 17A, 17B, 17C, and 17D according to an embodiment of the present invention. Steering fault 560 will be "high" for time segment 562 between $t_2$ and $t_3$, and for time segment 564 between $t_4$ and $t_7$. Both segments are the result of the OR gate response to inputs I2 and I3 of FIGS. 17C and 17D.

What is claimed is:

1. A retractable rudder system for water-jet powered watereraft comprising:

at least one rudder pivotally disposed to rotate about a generally horizontal axis between a retracted position and a deployed position, said at least one rudder being rotatable by a steering mechanism about a generally vertical axis when in said deployed position;

control means responsive to a throttle condition of the watercraft's throttle mechanism, an immersion condition of the watercraft's hull, a watercraft speed condition, a jet pump pressure condition of the watercraft's jet pump, a steering fault condition of the watercraft's steering mechanism, and operative to generate an actuator control signal when the five conditions have predetermined states; and actuator means responsive to said control signal and operative to cause said at least one rudder to rotate from said retracted position to said deployed position.

2. A retractable rudder system as recited in claim 1 wherein said control means generates said actuator control signal when:

the throttle condition is in an "OFF" state;

the steering fault condition is in an "ON" state;

the immersion condition indicates the watercraft's hull is in water; and, said jet pump pressure condition is below a predetermined minimum pump pressure value or said watercraft speed condition is below a predetermined speed value.

3. A retractable rudder system as recited in claim 2 wherein said throttle condition is in said "OFF" state when:

an engine powering the jet pump of the watercraft is not running, or the operator controlled throttle mechanism is at an engine idle position.

4. A retractable rudder system as recited in claim 2 wherein said steering fault condition is in said "ON" state when a steering angle sensor associated with said steering mechanism indicates a left or right full lock condition.

5. A retractable rudder system as recited in claim 2 wherein said steering fault condition is in said "ON" state when a first derivative of the steering angle of said steering mechanism with respect to time exceeds a first derivative of the steering angle of said steering mechanism with respect to first predetermined value.

6. A retractable rudder system as recited in claim 2 wherein said steering fault condition is in said "ON" state when said first derivative of the steering angle with respect to time exceeds a second predetermined value and the second derivative of steering angle with respect to time is greater than zero.

7. A retractable rudder system as recited in claim 2 wherein said predetermined speed value is about 20 miles per hour.

8. A retractable rudder system as recited in claim 2 wherein said control means causes throttle reapplication should said boat speed fall below said predetermined speed value.

9. A retractable rudder system as recited in claim 1, wherein:

said at least one rudder is capable of altering the direction of the watercraft when in the deployed position.

10. A retractable rudder system as recited in claim 9 wherein:

said at least one rudder is coupled to the steering nozzle of the watercraft.

11. A retractable rudder system as recited in claim 1 wherein said actuator means includes:

a first actuator coupled to a first connecting member;

a latch mechanism coupled to said first connecting member, said latch mechanism being selectively disposed in either a latched configuration or an unlatched configuration, said latched configuration being operative to retain said at least one rudder in said retracted position, wherein activation of said first actuator places said latch mechanism in said unlatched configuration, causing said at least one rudder to be released from retention;

a second actuator having an extendable linear member; and a second connecting member coupled to said at least one rudder and engaging said extendable linear member such that activation of said second actuator causes said at least one rudder to rotate about said generally horizontal axis from said retracted position to said deployed position.

12. A retractable rudder system as recited in claim 11, wherein the rate at which said at least one rudder rotates from the retracted position to the deployed position is dependent on the watercraft speed condition.

13. A retractable rudder system as recited in claim 12, wherein said second actuator causes said at least one rudder to rotate at a maximum rate from the retracted position to the deployed position if the watercraft speed condition is less than or equal to 20 miles per hour;

said at least one rudder to rotate at a minimum rate from the retracted position to the deployed position if the watercraft speed condition is greater than or equal to 40 miles per hour; and causes said at least one rudder to rotate at a rate between said maximum and said minimum from the retracted position to the deployed position if the watercraft speed condition is between 20 and 40 miles per hour.

14. A retractable rudder system as recited in claim 11, wherein said first actuator includes an electric solenoid and said first connecting member is chosen from the group consisting of a wire, cord, rope, chain, or cable.

15. A retractable rudder system as recited in claim 11, wherein said second actuator includes a hydraulic or pneumatic cylinder.

16. A retractable rudder system as recited in claim 15, wherein said second actuator is fluidically coupled to a first solenoid valve and a second solenoid valve;

said first solenoid valve is fluidically coupled to a first restrictor; and said second solenoid valve is fluidically coupled to a second restrictor, such that opening said first solenoid valve causes said at least one rudder to rotate about said generally horizontal axis at said minimum rate from the retracted position to the deployed position, opening both first and second solenoid valves causes said at least one rudder to rotate about said generally horizontal axis at said maximum rate from the retracted position to the deployed position, and opening said second solenoid valve causes said at least one rudder to rotate about said generally horizontal axis at a rate between said maximum and said minimum from the retracted position to the deployed position.

17. A retractable rudder system as recited in claim 16 wherein said second actuator is fluidically coupled to a check valve, and said check valve is fluidically coupled to a pressure source.

18. A retractable rudder system as recited in claim 17 wherein:

said first and second restrictors are fluidically coupled to a pressure source.

19. A retractable rudder system as recited in claim 2 wherein said control means includes a steering angle sensor associated with said steering mechanism, having a steering position output;

a watercraft speed sensor having a watercraft speed output;

a jet pump pressure sensor associated with the watercraft's jet pump, having a jet pump pressure output;

a hull immersion sensor having a hull immersion output;

a throttle position sensor associated with the watercraft's throttle mechanism, having a throttle position output;

an engine speed sensor associated with the watercraft's propulsion engine, having an engine speed output; and an electronic control unit having a steering position sensor input coupled to said steering position output, a watercraft speed sensor input coupled to said watercraft speed output, a jet pump pressure sensor input coupled to said jet pump pressure output, a hull immersion sensor input coupled to said hull immersion output, a throttle position sensor input coupled to said throttle position output, an engine speed sensor input coupled to said engine speed sensor output, a deploy rudder output, a first deployment rate output, and a second deployment rate output useful for deploying said retractable rudder system.

20. A retractable rudder system as recited in claim 19 wherein:

said steering angle sensor provides a continuous indication of steering angle between left full lock and right full lock steering positions; and said steering angle sensor indicates left full lock and right full lock steering positions.

21. A retractable rudder system as recited in claim 19 wherein said watercraft speed indicator is chosen from among: a Pito tube sensor, a global positioning satellite sensor, a surface velocity sensor, a paddle wheel sensor.

22. A retractable rudder system as recited in claim 20 wherein said electronic control unit includes:

an anticipated steering module electrically coupled to said steering position input, said anticipated steering module having a steering fault output, said steering fault output being indicative of the state of said steering fault condition.

23. A retractable rudder system as recited in claim 22 wherein said anticipated steering module produces an "ON" state of said steering fault condition when said steering angle sensor indicates said left full lock or said right full lock steering positions; or a first derivative of said steering angle with respect to time exceeds a first predetermined value; or said first derivative of said steering angle with respect to time exceeds a second predetermined value and a second derivative of said steering angle with respect to time is greater than zero.

24. A retractable rudder system as recited in claim 19 wherein said electronic control unit generates said actuator control signal when said deploy rudder output is "ON".

25. A retractable rudder system as recited in claim 19 wherein said electronic control unit causes said at least one rudder to rotate at a minimum rate from the retracted position to the deployed position by turning said first deployment rate output "ON"while maintaining said second deployment rate output "OFF";

causes said at least one rudder to rotate at a maximum rate from the retracted position to the deployed position by turning both said first and said second deployment rate outputs "ON"; and causes said at least one rudder to rotate at a rate between said maximum and said minimum from the retracted position to the deployed position by turning said second deployment rate output "ON" while maintaining said first deployment rate output "OFF".

26. A retractable rudder system as recited in claim 25 wherein said electronic control unit:

turns said first deployment rate output "ON", while maintaining said second deployment rate output "OFF", for watercraft speeds greater than or equal to 40 miles per hour;

turns said second deployment rate output "ON", while maintaining said first deployment rate output "OFF", for watercraft speeds between 20 and 40 miles per hour; and turns both said first and said second deployment rate outputs "ON" for watercraft speeds less than or equal to 20 miles per hour.

27. A method for engaging a retractable rudder system for watercraft comprising:

pivotally disposing at least one rudder to rotate about a generally horizontal axis between a retracted position and a deployed position, said at least one rudder being rotatable by a steering mechanism about a generally vertical axis when in said deployed position;

generating an actuator control signal responsive to a throttle condition of the watercraft's throttle mechanism, an immersion condition of the watercraft's hull, a watercraft speed condition, a jet pump pressure condition, a steering fault condition of the watercraft's steering mechanism, and operative when the five conditions have predetermined states; and causing said at least one rudder to rotate from said retracted position to said deployed position in response to said control signal.

28. A method for engaging a retractable rudder system as recited in claim wherein said actuator control signal is generated by a control means when said throttle condition is in an "OFF" state;

said steering fault condition is in an "ON" state;

said immersion condition indicates the watercraft's hull is in water; and, said jet pump pressure condition is below a predetermined minimum pump pressure value or said watercraft speed condition is below a predetermined speed value.

29. A method for engaging a retractable rudder system as recited in claim including placing said throttle condition in said "OFF" state when an engine powering the jet pump of the watercraft is not running, or an operator controlled throttle mechanism is at an engine idle position.

30. A method for engaging a retractable rudder system as recited in claim including placing said steering fault condition in said "ON" state when a steering angle sensor associated with said steering mechanism indicates a left or right full lock condition.

31. A method for engaging a retractable rudder system as recited in claim 28 including placing said steering fault condition is in said "ON" state when a first derivative of the steering angle of said steering mechanism with respect to time exceeds a first predetermined value.

32. A method for engaging a retractable rudder system as recited in claim 28 including placing said steering fault condition in said "ON" state when said first derivative of steering angle with respect to time exceeds a second predetermined value and a second derivative of steering angle with respect to time is greater than zero.

33. A method for engaging a retractable rudder system as recited in claim 28 wherein said second predetermined value is about 20 miles per hour.

34. A method for engaging a retractable rudder system as recited in claim 28 including engaging throttle reapplication if said watercraft speed is below said predetermined speed value.

35. A method for engaging a retractable rudder system as recited in claim 27 further comprising altering the direction of said watercraft in response to steering inputs when said at least one rudder is in said deployed position.

36. A method for engaging a retractable rudder system as recited in claim 35 including coupling said at least one rudder to the steering nozzle of the watercraft.

37. A method for engaging a retractable rudder system as recited in claim 27 further comprising the steps of:

coupling a first actuator to a first connecting member;

coupling a latch mechanism to said first connecting member, said latch mechanism being selectively disposed in either a latched configuration or an unlatched configuration, said latched configuration being operative to retain said at least one rudder in said retracted position, wherein activation of said first actuator places said latch mechanism in said unlatched configuration, causing said at least one rudder to be released from retention;

providing a second actuator having an extendable linear member; and coupling a second connecting member to said at least one rudder and engaging said extendable linear member such that activation of said second actuator causes said at least one rudder to rotate about said generally horizontal axis from said retracted position to said deployed position.

38. A method for engaging a retractable rudder system as recited in claim 37 including rotating said at least one rudder from the unlatched retracted position to the deployed position at a rate which is dependent on the watercraft's speed condition.

39. A method for engaging a retractable rudder system as recited in claim 38 including rotating said at least one rudder at a maximum rate from the retracted position to the deployed position if the watercraft's speed condition is less than or equal to 20 miles per 4 hour;

rotating said at least one rudder at a minimum rate from the retracted position to the deployed position if the watercraft's speed condition is greater than or equal to 40 miles per hour; and, rotating said at least one rudder at a rate between said maximum and said minimum from the retracted position to the deployed position if the watercraft's speed condition is between 20 and 40 miles per hour.

40. A method for engaging a retractable rudder system as recited in claim 37, wherein said first actuator includes an electric solenoid and said first connecting member is chosen from the group consisting of a wire, cord, rope, chain, or cable.

41. A method for engaging a retractable rudder system as recited in claim 37, wherein said second actuator includes a hydraulic or pneumatic cylinder.

42. A method for engaging a retractable rudder system as recited in claim 41 including the steps of fluidically coupling said second actuator to a first solenoid valve and a second solenoid valve;

fluidically coupling said first solenoid valve to a first restrictor; and fluidically coupling said second solenoid valve to a second restrictor, such that opening said first solenoid valve causes said at least one rudder to rotate about said generally horizontal axis at said minimum rate from the retracted position to the deployed position, opening both first and second solenoid valves causes said at least one rudder to rotate about said generally horizontal axis at said maximum rate from the unlatched retracted position to the deployed position, and opening said second solenoid valve causes said at least one rudder to rotate about said generally horizontal axis at a rate between said maximum and said minimum from the unlatched retracted position to the deployed position.

43. A method for engaging a retractable rudder system as recited in claim 42 including the steps of fluidically coupling said second actuator to a check valve, and fluidically coupling said check valve to a pressure source.

44. A method for engaging a retractable rudder system as recited in claim 43 including fluidically coupling said first and second restrictors to a pressure source.

45. A method for engaging a retractable rudder system as recited in claim 28, wherein said control means includes a steering angle sensor associated with said steering mechanism, having a steering position output;

a watercraft speed sensor having a watercraft speed output;

a jet pump pressure sensor associated with the watercraft's jet pump, having a jet pump pressure output;

a hull immersion sensor having a hull immersion output;

a throttle position sensor associated with the watercraft's throttle mechanism, having a throttle position output;

an engine speed sensor associated with the watercraft's propulsion engine, having an engine speed output; and an electronic control unit having a steering position sensor input coupled to said steering position output, a watercraft speed sensor input coupled to said watercraft speed output, a jet pump pressure sensor input coupled to said jet pump pressure output, a hull immersion sensor input coupled to said hull immersion output, a throttle position sensor input coupled to said throttle position output, an engine speed sensor input coupled to said engine speed sensor output, a deploy rudder output, a first deployment rate output, and a second deployment rate output useful for deploying said retractable rudder system.

46. A method for engaging a retractable rudder system as recited in claim 45 including providing a continuous indication of steering angle between left full lock and right full lock steering positions from said steering angle sensor; and having said steering angle sensor indicate left full lock and right full lock steering positions.

47. A method for engaging a retractable rudder system as recited in claim 45 wherein said watercraft speed indicator is chosen from among: a Pito tube sensor, a global positioning satellite sensor, a surface velocity sensor, a paddle wheel sensor.

48. A method for engaging a retractable rudder system as recited in claim 46, wherein said electronic control unit further includes an anticipated steering module electrically coupled to said steering position input, said anticipated steering module having a steering fault output, said steering fault output being indicative of the state of said steering fault condition.

49. A method for engaging a retractable rudder system as recited in claim 48 wherein said anticipated steering module produces an "ON" state of said steering fault condition when:

said steering angle sensor indicates said left full lock or said right full lock steering positions; or a first derivative of said steering angle with respect to time exceeds a first predetermined value; or said first derivative of said steering angle with respect to time exceeds a second predetermined value and a second derivative of said steering angle with respect to time is greater than zero.

50. A method for engaging a retractable rudder system as recited in claim 45 including having said electronic control unit generate said actuator control signal when said deploy rudder output is "ON".

51. A method for engaging a retractable rudder system as recited in claim 45 including causing said at least one rudder to rotate about said generally horizontal axis at a minimum rate from the retracted position to the deployed position by turning said first deployment rate output "ON" while maintaining said second deployment rate output "OFF";

causing said at least one rudder to rotate about said generally horizontal axis at a maximum rate from the retracted position to the deployed position by turning both said first and said second deployment rate outputs "ON"; and causing said at least one rudder to rotate about said generally horizontal axis at a rate between said maximum and said minimum from the retracted position to the deployed position by turning said second deployment rate output "ON" while maintaining said first deployment rate output "OFF".

52. A method for engaging a retractable rudder system as recited in claim 51 including turning said first deployment rate output "ON", while maintaining said second deployment rate output "OFF", for watercraft speeds greater than or equal to 40 miles per hour;

turning said second deployment rate output "ON", while maintaining said first deployment rate output "OFF", for watercraft speeds between 20 and 40 miles per hour; and turning both said first and said second deployment rate outputs "ON" for watercraft speeds less than or equal to 20 miles per hour.

* * * * *